US012649505B2

(12) United States Patent
Ruhland et al.

(10) Patent No.: US 12,649,505 B2
(45) **Date of Patent: *Jun. 9, 2026**

(54) METHOD AND SYSTEM FOR TRANSMITTING ENFORCEABLE INSTRUCTIONS IN VEHICLE CONTROL SYSTEMS

(71) Applicant: Transportation IP Holdings, LLC, Norwalk, CT (US)

(72) Inventors: Kristofer M. Ruhland, Cedar Rapids, IA (US); Karen A. Shaw, Cedar Rapids, IA (US); James L. Fenske, Marion, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 416 days.

This patent is subject to a terminal disclaimer.

(21) Appl. No.: 18/133,702

(22) Filed: Apr. 12, 2023

(65) Prior Publication Data

US 2023/0249728 A1 Aug. 10, 2023

Related U.S. Application Data

(63) Continuation-in-part of application No. 17/145,874, filed on Jan. 11, 2021, now Pat. No. 11,827,259, which is a continuation of application No. 16/110,415, filed on Aug. 23, 2018, now Pat. No. 10,919,551, which is a continuation of application No. 14/032,710, filed on Sep. 20, 2013, now Pat. No. 10,081,378.

(Continued)

(51) Int. Cl.

| | |
|---|---|
| ***B61L 27/70*** | (2022.01) |
| ***B61L 3/12*** | (2006.01) |
| ***B61L 15/00*** | (2006.01) |
| ***B61L 23/04*** | (2006.01) |
| ***B61L 27/53*** | (2022.01) |

(52) U.S. Cl.
CPC ..... *B61L 27/70* (2022.01); *B61L 3/125* (2013.01); *B61L 15/0062* (2024.01); *B61L 15/0063* (2013.01); *B61L 23/041* (2013.01); *B61L 27/53* (2022.01)

(58) Field of Classification Search
CPC ..... B61L 27/70; B61L 27/53; B61L 15/0062; B61L 15/0063; B61L 3/125; B61L 23/041
See application file for complete search history.

(56) References Cited

U.S. PATENT DOCUMENTS 5,805,797 A * 9/1998 Sato ..... G06F 11/165 714/E11.017
7,395,141 B1 * 7/2008 Seck ..... B61C 17/12 701/19

(Continued)

FOREIGN PATENT DOCUMENTS

DE 102016215243 A1 2/2018

*Primary Examiner* — Peter D Nolan
*Assistant Examiner* — Wae L Louie
(74) *Attorney, Agent, or Firm* — K&L Gates LLP

(57) ABSTRACT

A method and a system for transmitting an enforceable instruction in a vehicle control system may include receiving a checksum contained in at least one enforceable instruction. Methods for checksum challenge mitigation in a vehicle control system and verifying enforceable instruction data on-board a vehicle are disclosed.

20 Claims, 20 Drawing Sheets

Related U.S. Application Data

(60) Provisional application No. 61/703,531, filed on Sep. 20, 2012.

(56) References Cited

U.S. PATENT DOCUMENTS 8,714,494 B2 * 5/2014 Weber ..... B61L 15/0027 701/19
9,233,698 B2 1/2016 Weber et al.
9,283,945 B1 * 3/2016 Kernwein ..... B60T 17/228
10,919,551 B2 * 2/2021 Ruhland ..... B61L 23/041
2003/0213875 A1 * 11/2003 Hess, Jr. ..... B61L 25/028 246/167 R
2004/0019696 A1 * 1/2004 Scott ..... H04L 67/02 709/242
2004/0093196 A1 * 5/2004 Hawthorne ..... B61L 15/0072 703/8
2004/0230982 A1 * 11/2004 Wookey ..... G06Q 10/00 709/201
2005/0205718 A1 * 9/2005 Tsai ..... B61L 23/041 246/1 R
2006/0022063 A1 * 2/2006 Tsai ..... E01B 26/00 238/8
2006/0037528 A1 * 2/2006 Farritor ..... E01F 9/688 116/200
2011/0075641 A1 * 3/2011 Siriwongpairat ..... H04W 4/12 370/337
2011/0267184 A1 * 11/2011 Lee ..... G08G 1/16 348/E7.085
2011/0276285 A1 * 11/2011 Alexander ..... B61L 1/20 702/58
2012/0123617 A1 * 5/2012 Noffsinger ..... B61L 15/0081 701/19
2014/0014784 A1 * 1/2014 Brown ..... B61L 15/0027 246/167 D
2014/0107875 A1 * 4/2014 Beyer ..... B61L 15/0036 701/19
2014/0131524 A1 * 5/2014 Grimm ..... B61L 27/00 246/3
2014/0172205 A1 * 6/2014 Ruhland ..... B61L 15/0063 701/19
2015/0375764 A1 * 12/2015 Rajendran ..... G05D 1/0027 455/90.3
2016/0001801 A1 * 1/2016 Ruhland ..... B61L 15/0018 701/19
2017/0090473 A1 * 3/2017 Cooper ..... H04W 76/11
2019/0263432 A1 * 8/2019 Carlson ..... B61L 27/70
2020/0001906 A1 * 1/2020 Bramucci ..... B61L 15/0072
2021/0403062 A1 * 12/2021 Bramucci ..... B61L 3/125
2023/0249728 A1 * 8/2023 Ruhland ..... B61L 15/0063 701/19
2023/0373484 A1 * 11/2023 Brooks ..... B60W 30/16

* cited by examiner

Note: G BOS requests the locomotive configuration and the IC3 Composite CRC at the same time. The order of requesting the locomotive configuration and IC3 Composite CRC does not matter.

Table 1 CRC Behaviors

| Message sent to on-board | G BOS Mode | Dataset CRC | IC3 Composite CRC | IC3 Authority or Void CRC | IC3 Bulletin or Void CRC | Onboard Response | G BOS Response |
|---|---|---|---|---|---|---|---|
| Movement Authority Dataset (01051) | n/a | n/a | n/a | match | n/a | existing | existing |
| Movement Authority Dataset (01051) | n/a | n/a | n/a | no match | n/a | Set sub to "non-sync", Send 02052 message with enumeration for IC3 Authority CRC mismatch | EV, CFG response |
| Movement Authority Void | n/a | n/a | n/a | match | n/a | existing | existing |
| Movement Authority Void (01053) | n/a | n/a | n/a | no match | n/a | Set sub to "non-sync", Send 02053 message with enumeration for IC3 Authority Void CRC mismatch | EV, CFG response |
| Bulletin Dataset (01041) | n/a | n/a | n/a | n/a | match | existing | existing |
| Bulletin Dataset (01041) | n/a | n/a | n/a | n/a | no match | Set sub to "non-sync", Send 02042 message with enumeration for IC3 Bulletin CRC mismatch | EV, CFG response |
| Bulletin Cancellation (01043) | n/a | n/a | n/a | n/a | match | existing | existing |
| Bulletin Cancellation (01043) | n/a | n/a | n/a | n/a | no match | Set sub to "non-sync", Send 02043 message with enumeration for IC3 Bulletin Void CRC mismatch | EV, CFG response |
| Office Segment Poll (01021) | Explicit Control | match | match | n/a | n/a | existing | existing |
| Office Segment Poll (01021) | Explicit Control | match | no match | n/a | n/a | send 02020 message to request new poll, NAK w/02021 message if CRC in 2nd poll mismatches, set sub to "non-sync" | EV, CFG response |
| Office Segment Poll (01021) | Explicit Control | no match | not checked | n/a | n/a | Resync with BOS, request another poll. If condition persists set sub to "non-sync" | Sync w/onboard |
| Office Segment Poll (01021) | Non-explicit Control | match | not checked | n/a | n/a | Resync with BOS, request another poll. If condition persists set sub to "non-sync" | existing |
| Office Segment Poll (01021) | Non-explicit Control | no match | not checked | n/a | n/a | existing | existing |
| Office Segment Poll (01021) | Synchronized | not checked | not checked | n/a | n/a | existing | existing |

FIG. 5C

* IC3 computed CRC over the individual Authority
** IC3 computed CRC over all Bulletin and Authority CRCs for a Train ID per subdivision/district ^ A single Replicator is shown for clarity. Wabtec is proposing two, one between Railroad Systems and IC3/BOS Instance and the other between On-board and IC3/BOS Instance.

METHOD AND SYSTEM FOR TRANSMITTING ENFORCEABLE INSTRUCTIONS IN VEHICLE CONTROL SYSTEMS

CROSS REFERENCE TO RELATED APPLICATIONS

This application is a continuation-in-part of U.S. patent application Ser. No. 17/145,874, filed on Jan. 11, 2021, which was a continuation of U.S. patent application Ser. No. 16/110,415, filed Aug. 23, 2018 (now U.S. Pat. No. 10,919,551), which was a continuation of U.S. patent application Ser. No. 14/032,710, filed Sep. 20, 2013 (now U.S. Pat. No. 10,081,378), which claimed the benefit of U.S. Provisional Application No. 61/703,531, filed Sep. 20, 2012, the disclosures of which are hereby incorporated in their entirety by reference.

BACKGROUND

Technical Field

Embodiments are related to vehicle control systems and to a method and system for transmitting an enforceable instruction therefor.

Discussion of Art

There are potential challenges associated with historical designs of Back-office Servers (BOS) in conventional positive train control (PTC) systems. For example, the manner in which conventional PTC systems transform and transfer enforceable instruction data to an on-board system after the enforceable instruction data is received from a computer aided dispatch (CAD) in vehicle control systems may contain errors. An enforceable instruction may contain a movement authority issued to a train by a dispatch system that may allow the train to move into a particular route segment. Two identified challenges include the BOS normalization process may cause enforceable instruction data received by the on-board system to differ from the enforceable instruction data that was sent by the dispatch system; and the BOS may not associate an enforceable instruction with the correct vehicle group, may be corrupted, or may be outdated (even if at the right vehicle and in proper format).

The first challenge is associated with the manner in which the PTC system handles enforceable instruction data after the enforceable instruction data is received from the dispatch system. A conventional process for issuing an enforceable instruction from a dispatch system to the on-board system is described below and illustrated in FIG. 1. The dispatch system sends an enforceable instruction to a geographic BOS (G BOS). The G BOS is a BOS for a segment of routes contained in a defined area, and often controlled by a railroad. The enforceable instruction may contain operational information for a train to enter into a region, and how to operate while there. While a Movement Authority may indicate that a vehicle can move into a route segment (because there is no other vehicle in that segment), the Bulletin may relay that the track health is low and may provide an upper limit on the speed at which the vehicle can move through that segment.

For a rail based system, these messages may be sent to an on-board system disposed on the locomotive and to other vehicles in a vehicle group associated with the locomotive. One potential challenge associated with G BOS conversion of operational enforceable instruction set (shown as Hazard in FIG. 1) is that the on-board system enforces incorrect operational enforceable instruction set due to enforceable instruction set received by the on-board segment differing from the data sent by dispatch system. The G BOS normalization may cause the enforceable instruction set to be changed from, or be corrupted relative to, the enforceable instruction set that was initially sent by the dispatch system to the G BOS. Conventional PTC systems may not include a method or system for ensuring the integrity of the BOS segment transmission of an enforceable instruction to locomotives.

A second challenge is that the G BOS may not associate an enforceable instruction with the correct locomotive(s) and/or train(s). An incorrect association may result in the on-board system having a wrong set of enforceable instruction data and providing incorrect operational data. FIG. 2 shows a conventional enforceable instruction delivery method with the second challenge identified. It may be desirable to have a system and method that differs from those that are currently available.

BRIEF DESCRIPTION

A method and system are provided for transmitting an enforceable instruction in positive vehicle control systems (PVC), such as the positive train control (PTC) system, that addresses transmitting an enforceable instruction in PVC systems, including, but not limited to, the I-ETMS® of Wabtec Corp.

A method is provided that includes transmitting an enforceable instruction from a dispatch system to at least one vehicle of a vehicle group. The enforceable instruction includes a movement authority for a determined route segment, a checksum component configured to determine validity of the enforceable instruction, and an authentication component configured to determine the authenticity of the enforceable instruction; and operating the at least one vehicle according to the movement authority.

A vehicle control system is provided that includes a controller. The controller can transmit an enforceable instruction from a dispatch system to at least one vehicle of a vehicle group. The enforceable instruction may include a movement authority for a determined route segment, a checksum component that can determine validity of the enforceable instruction, and/or an authentication component that can determine the authenticity of the enforceable instruction. The controller can operate the at least one vehicle according to the movement authority.

A positive vehicle control system may be provided that includes a controller. The controller can transmit an enforceable instruction from a dispatch system to at least one vehicle (e.g., a locomotive) of a vehicle system or vehicle group (e.g., a train). The enforceable instruction may include a movement authority for a determined route segment, a checksum component that can determine validity of the enforceable instruction, and/or an authentication component that can determine the authenticity of the enforceable instruction. The controller further can determine that the locomotive is the correct locomotive for the enforceable instruction and can operate the locomotive according to the movement authority. The controller can transmit a bulletin message to locomotive, and to operate the locomotive with a limit or restriction provided by the bulletin message and according to the movement authority in the route segment.

BRIEF DESCRIPTION OF THE DRAWINGS

FIG. 5C is a table showing PVC systems behaviors according to an embodiment;

DETAILED DESCRIPTION

Figure 1:
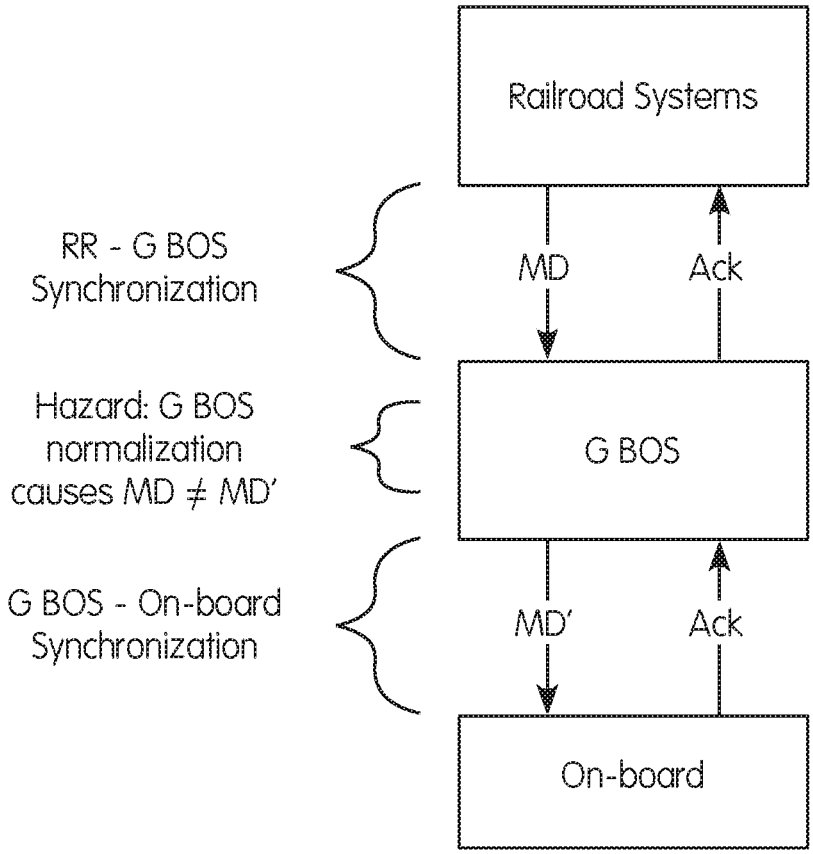
FIG. 1 (Prior Art)
FIG. 1 is a flow chart illustrating a geographic back-office server (G BOS) normalization challenge in a conventional positive vehicle control (PVC) system.
Figure 2:
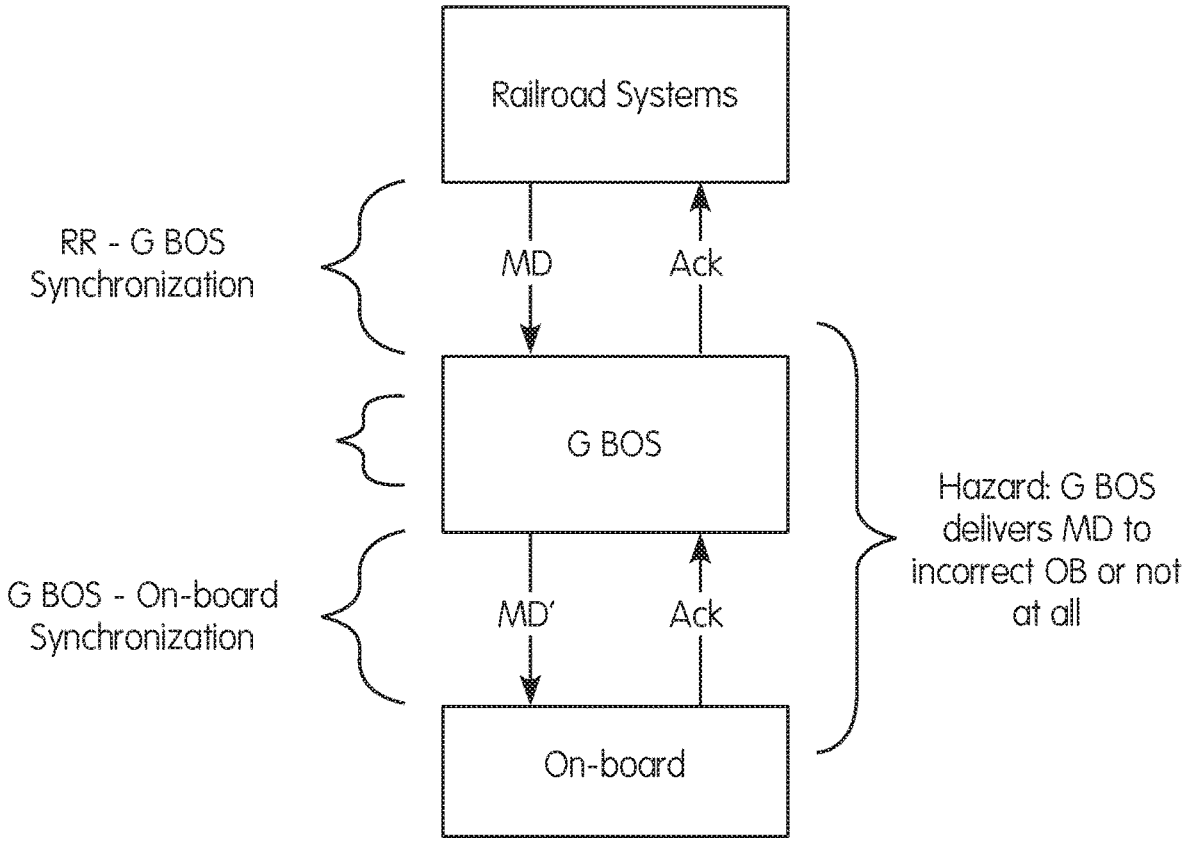
FIG. 2 (Prior Art)
FIG. 2 is a flow chart illustrating a G BOS association challenge in a conventional PVC system.

Embodiments disclosed herein relate to vehicle control and communications systems and to a method and system for transmitting enforceable and validated/authenticated instructions therefor. Embodiments may verify an instructional data set or instruction's data integrity, data authenticity, or both integrity and authenticity—collectively referred to as an enforceable instruction. The enforceable instruction may include geographic or other boundaries (e.g., time) that are referred to as limits.

A suitable vehicle control system may include a central dispatch and/or control system (such as a railroad), a central mining vehicle control system, an automotive vehicle control system, an agricultural vehicle control system, an aircraft fleet control system, and the like. Vehicles may be pilot operated (with a vehicle system override), may be autonomous (operated by a vehicle control unit), and the like. And the vehicles may be individual or may be grouped (into vehicle groups), and the vehicles in a vehicle group may be mechanically coupled; or, may be logically (or virtually or communicatively) coupled together without being mechanically coupled. Vehicle groups may be fixed and static; or they may be dynamically determined with individual vehicles entering and/or exiting the vehicle group. For an individual vehicle, the vehicle should be in communication with a vehicle control system at least periodically. If a vehicle group, at least one vehicle in the group should be in communication with the vehicle control system and should be able to influence the operation of the vehicle group of which it is a part. Example vehicle groups may be a train, swarm, consist, fleet, and the like. Example vehicles may be automobiles, locomotives, marine vessels, airplanes, aerial drones, on-road trucks, mining equipment, agricultural equipment, and the like. Not all embodiments of the inventive subject matter are limited to any particular type of vehicle unless the embodiment is explicitly limited to one particular type of vehicle (e.g., rail vehicles, over-the-road vehicles (such as automobiles, trucks, buses, etc.), mining vehicles, agricultural vehicles, aircraft, etc.). Reference herein to one particular type or category of vehicles in connection with an example or embodiment does not mean that the example or embodiment is exclusively limited to that particular vehicle, vehicle type, or vehicle category (unless expressly limited in that way).

The verification determination may be performed by the vehicle control system (centralized), the vehicle (on-board), the BOS, or a combination thereof. Suitable verification determinations may include one or more of a checksum, a hash function, a randomization function, and the like. A suitable checksum may include a cyclic redundancy check (CRC), Fletcher's checksum, Alder-32, fuzzy checksum, and the like. The components performing the verification determination may be referred to as a system, controller, etc., and may include hardware circuitry that includes and/or is connected with one or more processors (e.g., microprocessors, field programmable gate arrays, integrated circuits, or the like) that perform the operations and processes described herein.

A suitable hash function, useful for authentication, may be a cryptographic hash function. The hash function may be a message authentication code (MAC) or a message integrity code (MIC) or have features of each. In one embodiment, the enforceable instruction may include a network wide shared secret key, possibly using a private key of a public/private key pair. Other suitable hash functions, may include, for example, MD4, MD5, SHA-1 and SHA-2, and may be built from block-cipher-like components designed for vehicle communication. In one embodiment, concatenation may be used. A back office system may retain a host of passwords with each password corresponding to an item of equipment. The equipment may be a vehicle, wayside equipment (such as a crossing device, a switch, and the like), or both.

A suitable alternative authentication aspect may include a blockchain component. In one embodiment, signing and/or encryption keys may be stored onboard the vehicle. In another embodiment, verification and encryption keys may be stored on the blockchain, which may be kept in the cloud and/or in the back office of the vehicle control group. Biometrics, passwords, and the like may be used as an alternative or as part of a multi-factor authentication system. The authentication aspect may use non-fungible tokens (NFTs) to authenticate messages communicated with vehicles. Messages not having one or more acceptable NFTs may not be authenticated, while messages having the acceptable NFTs may be authenticated.

In one example, a vehicle control system may send an enforceable instruction in a PVC territory to a BOS, the enforceable instruction may include one or more limits or restrictions, as well as other components disclosed herein. The vehicle control system and the interface between the vehicle control system and a BOS may detect a missed enforceable instruction message in a timely manner. The vehicle control system may void an authority or bulletin by explicit message under certain determined circumstances. A corruption of message data in transit between a dispatch system in the vehicle control system and a BOS may be determined to be invalid. Corruption of message data in transit between an on-board system and a BOS may be determined as invalid. Receipt by a BOS of messages from an on-board system is not guaranteed. Receipt by an on-board system of messages from a BOS is not guaranteed.

A vehicle may have a unique designator or vehicle ID. When a vehicle group is constituted, that vehicle group may be assigned a vehicle group ID (which may be unique to that vehicle group). A vehicle group ID, then, may include a plurality of vehicles, each of the vehicle having a vehicle ID. In one embodiment, the vehicle group ID is static and immutable (until dissolution of the group). In another embodiment, the vehicle group ID may be modified as vehicles are added, or removed, from the vehicle group. When a vehicle control system issues an enforceable instruction with a vehicle ID and no vehicle group ID, the enforceable instruction may apply to the vehicle ID regardless of vehicle group ID. When a vehicle control system issues an enforceable instruction with a vehicle group ID and no vehicle ID, the enforceable instruction may apply to all vehicle IDs associated with that vehicle group ID. When a vehicle control system issues an enforceable instruction with one or more vehicle IDs and one or more vehicle group IDs, the enforceable instruction may apply to a vehicle ID in the enforceable instruction that is associated with a vehicle group ID in the enforceable instruction. When a vehicle control system issues an enforceable instruction with no vehicle ID and no vehicle group ID, the enforceable instruction may apply to all vehicle IDs and vehicle group IDs registering for polling for the associated subdivision/district. When a vehicle control system issues an enforceable instruction with no vehicle IDs and a list of excluded vehicle group IDs, the enforceable instruction may apply to all vehicle IDs associated with vehicle group IDs not listed as excluded. In one embodiment, vehicle control systems may not use data from a PVC system track database when issuing an enforceable instruction.

An individual and/or composite cyclic redundancy check (CRC) method and system (e.g., calculator, processor, program, and the like) are described in more detail below with respect to FIGS. 3-5, and in certain embodiments. A process may verify G BOS normalization and vehicle group association of enforceable instruction data. Each G BOS may be associated with a particular geographic region, e.g., a particular subdivision/district of a plurality of different subdivisions/districts of the PVC system. The process may generate data used by the on-board system to ensure that the G BOS delivers correct enforceable instruction data to the correct vehicle groups.

The process may use a checksum generator to generate a checksum value, and in some cases a CRC. A suitable checksum generator may be an individual and composite CRC Calculator (IC3). The IC3 may create two or more types of CRCs used by the on-board system, namely individual enforceable instruction (MD) CRCs and an IC3 composite CRC. The IC3 may not directly control or affect operations of vehicle control systems. Individual MD CRCs may be used within the PVC system to ensure each enforceable instruction data is correct when received by the on-board system. The IC3 composite CRC may be used within the PVC system to ensure that the on-board system has the correct set of enforceable instructions (e.g., right vehicle, right route segment, right time, and so on). In one embodiment, the IC3 may not share a component or data storage with the G BOS. In other embodiments, the IC3 process can be implemented or executed on a controller and may have shared components. A suitable controller may be located within or integrated with a central system, a remote system, a server system, a network system, an on-board system, or a combination thereof. Communication pathways may allow data and information to flow to where it may be used.

In one embodiment, and with respect to individual MD CRCs, the IC3 may generate individual MD CRCs calculated over defined sets of operational enforceable instruction data. For example, four individual MD CRCs may be calculated and may include one or more of an authority data CRC (IC3 authority CRC), a bulletin data CRC (IC3 bulletin CRC), an authority void CRC (IC3 authority void CRC), and a bulletin void CRC (IC3 bulletin void CRC). Each individual MD CRC may represent data for an individual enforceable instruction, including that the instruction may be void. Authority and bulletin data may each have a CRC to ensure there are no alterations of operational enforceable instruction data. This may be applicable as the G BOS transforms and/or transfers the data to the on-board system. Authority and bulletin void sets may each have a CRC to ensure that the G BOS transforms and/or transfers the correct reference number associated with a void. The use of an Individual MD CRC may ensure that G BOS normalization of a vehicle control system (of which there may be normally multiple, different vehicle control systems and/or multiple, different formatting schemes and rule sets) enforceable instruction data does not alter the movement authority and/or bulletin.

Figure 3A:
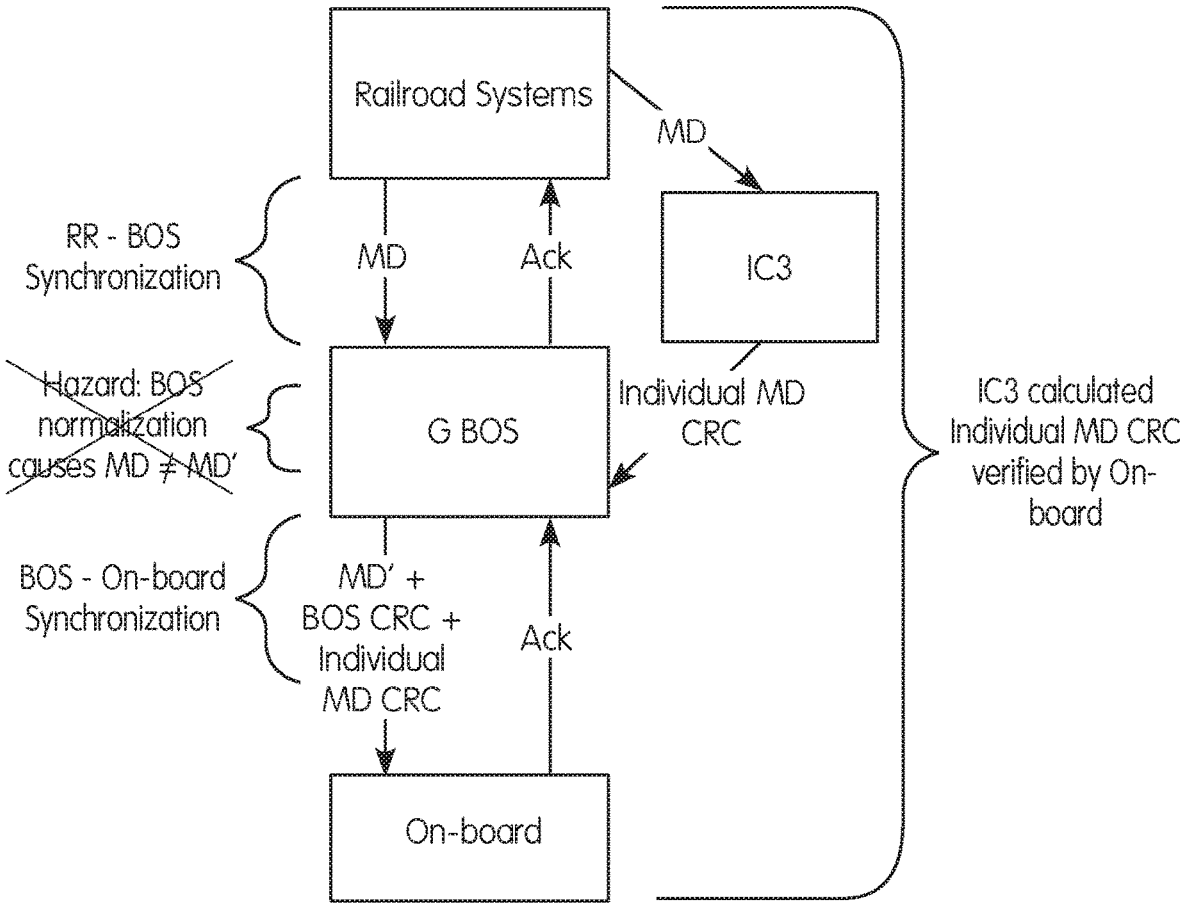
FIG. 3A is a flow chart illustrating a method and system for individual cyclic redundancy check (CRC) challenge mitigation according to an embodiment.

FIG. 3A is a flow chart illustrating a method for individual CRC challenge mitigation according to an embodiment. To calculate the individual MD CRCs, the IC3 receives messages sent to the G BOS from the on-board system and vehicle control systems (e.g., from a dispatch system in the vehicle control system), as well as messages sent from the G BOS to the on-board system and vehicle control systems. A replicator process is used so that the IC3 receives the G BOS messaging. A replicator sends a copy of each locomotive and vehicle control systems message communicated to the G BOS and to the IC3. Because the IC3 parses vehicle control systems messages, it is unique to each railroad.

The IC3 receives an enforceable instruction in the replicated message, converts the data into a neutral format that is the same for all railroads, and calculates the associated Individual MD CRC. When the G BOS receives an enforceable instruction from vehicle control systems, the G BOS requests and waits for the individual MD CRC from the IC3 before generating and sending the associated message. The IC3 accepts a class D connection from the G BOS process. The IC3 is responsible for receiving the Request individual MD CRC from G BOS. When the IC3 receives the request individual MD CRC message, it calculates the IC3 individual CRC over the enforceable instruction and populates and sends the individual MD CRC message to G BOS. If the IC3 receives the request individual MD CRC message requesting a CRC for enforceable instruction for which it has not stored data, the IC3 does not respond to the G BOS.

The G BOS may transform or convert the enforceable instruction data into a normalized format, which may be different from the neutral format, and may determine or calculate a BOS MD CRC based at least partly on the normalized data of the enforceable instruction. After the G BOS has received the individual MD CRC, the individual MD CRC may be added to the appropriate message with the normalized enforceable instruction and sent to the on-board system. The on-board system validates the individual MD CRC in addition to all existing validity checks. The on-board system may validate the integrity of an individual MD CRC by converting enforceable instruction data received from the BOS into the same neutral format used by the IC3 and then calculating the CRC. If the G BOS alters the enforceable instruction or the individual MD CRC, the on-board system detects the alteration through validation of the individual MD CRC.

When the on-board system receives the enforceable instruction, the on-board system compares the individual MD CRC in the message to an equivalent on-board calculated individual MD CRC. The on-board system calculates the on-board individual MD CRC based on the enforceable instruction data converted into the same neutral format used by the IC3. When the on-board system calculated individual MD CRC does not match the IC3 calculated individual MD CRC, the on-board system sends the appropriate confirmation message to the G BOS and becomes non-synchronized for the subdivision/district(s) associated with the mismatched individual MD CRC. When the G BOS receives the confirmation message from the on-board system the G BOS takes a determined responsive action. The Individual MD CRC verification process may mitigate one or more of the challenges described above in connection with normalizing the enforceable instruction data.

Figure 3B:
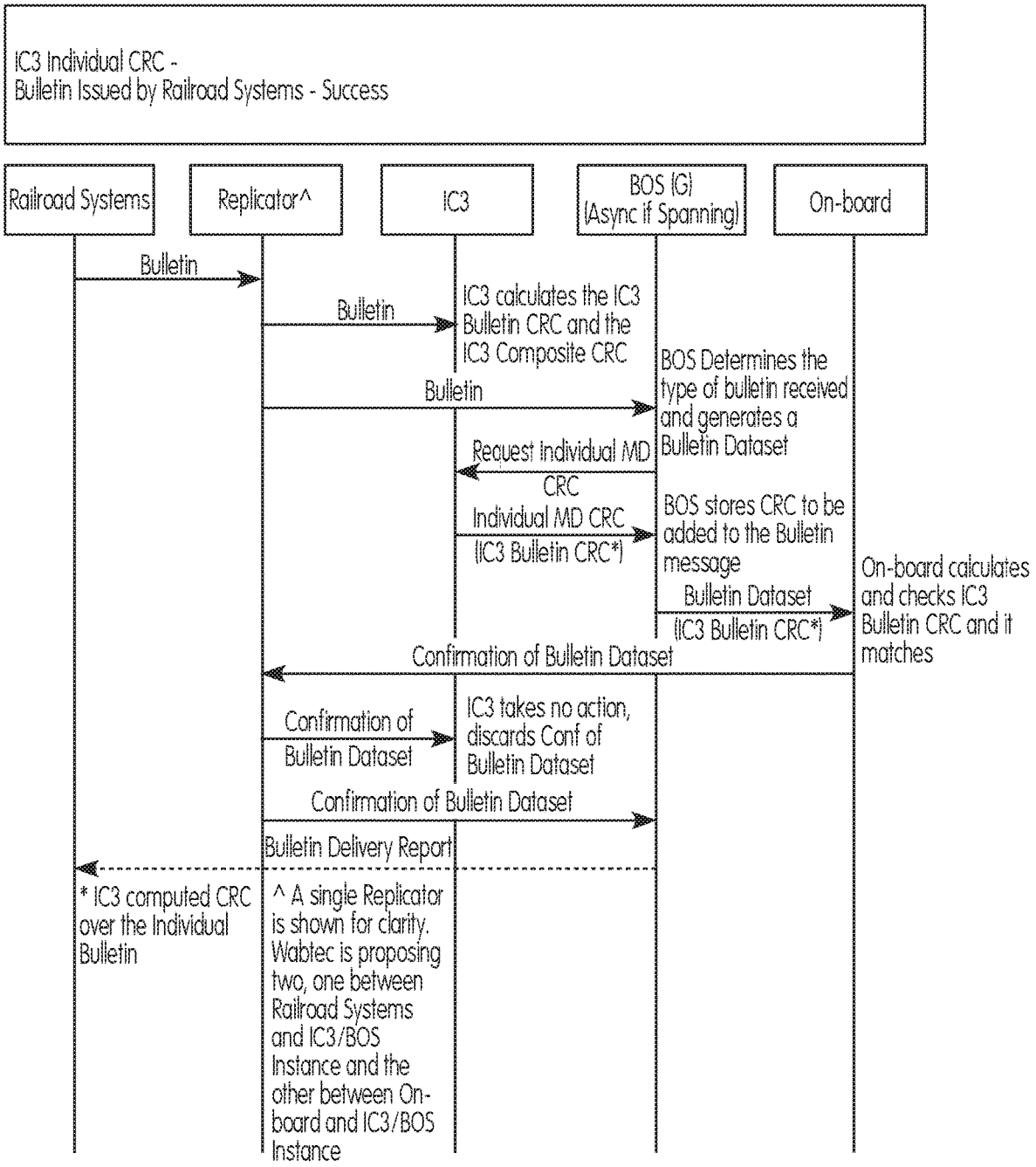
FIG. 3B is a signal/data flow chart illustrating a successful delivery of an enforceable instruction bulletin according to an embodiment.

Still referring to FIG. 3A, when the on-board system verifies the individual MD CRC for an enforceable instruction, the on-board system ensures operational data received from the vehicle control system is not altered. FIG. 3B is a signal/data flow chart illustrating a successful delivery of an enforceable instruction bulletin according to an embodiment. When operational data corruption is detected, the on-board system may set the associated subdivision/district to non-synchronized and perform associated existing behaviors. Further, the on-board system may issue flags, notices or alerts that indicate the status. For example, the on-board system indicates that it is not providing PVC protection while the vehicle group is operating in a non-synchronized subdivision/district through compliance with existing requirements for operating in a non-synchronized subdivision/district.

Figure 4A:
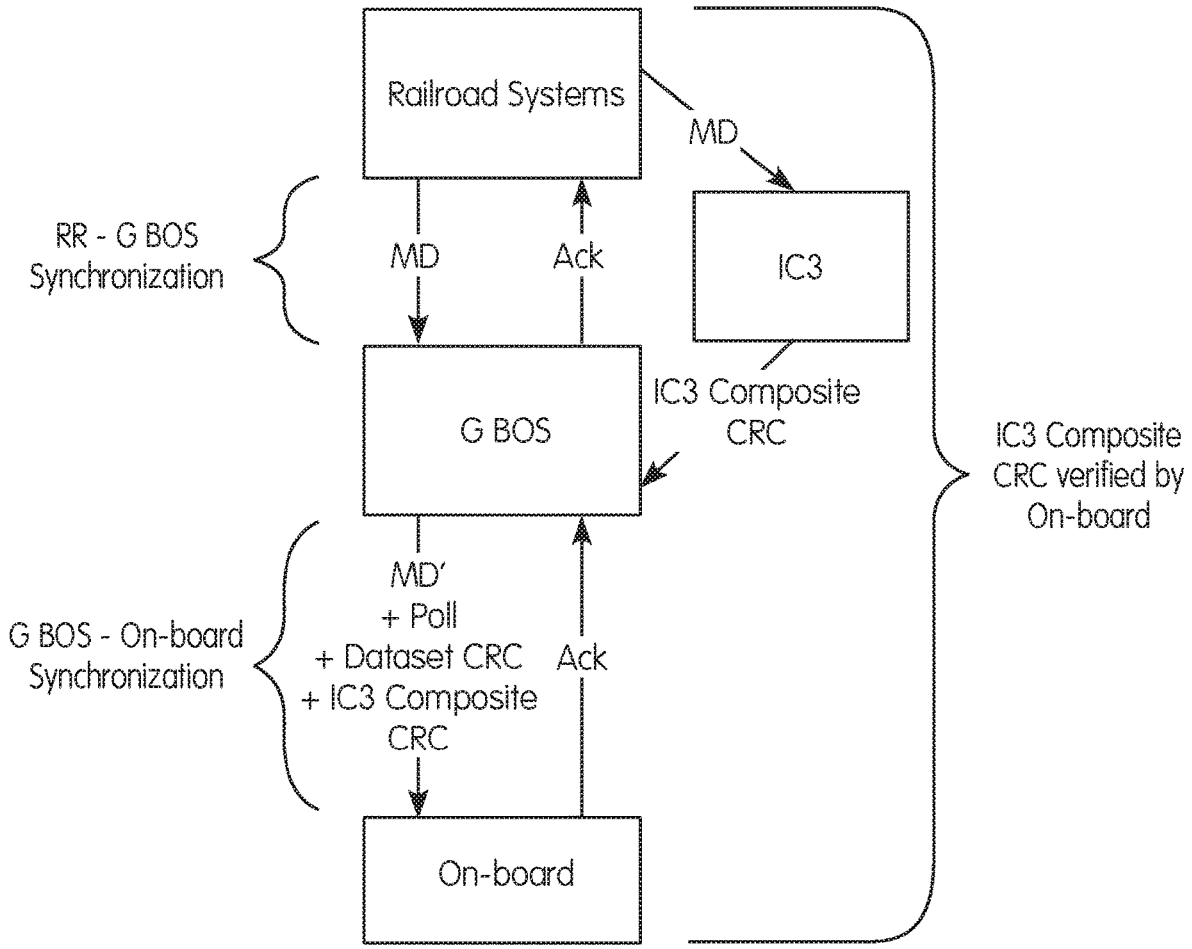
FIG. 4A is a flow chart illustrating a method and system for composite CRC challenge mitigation according to an embodiment.
Figure 4B:
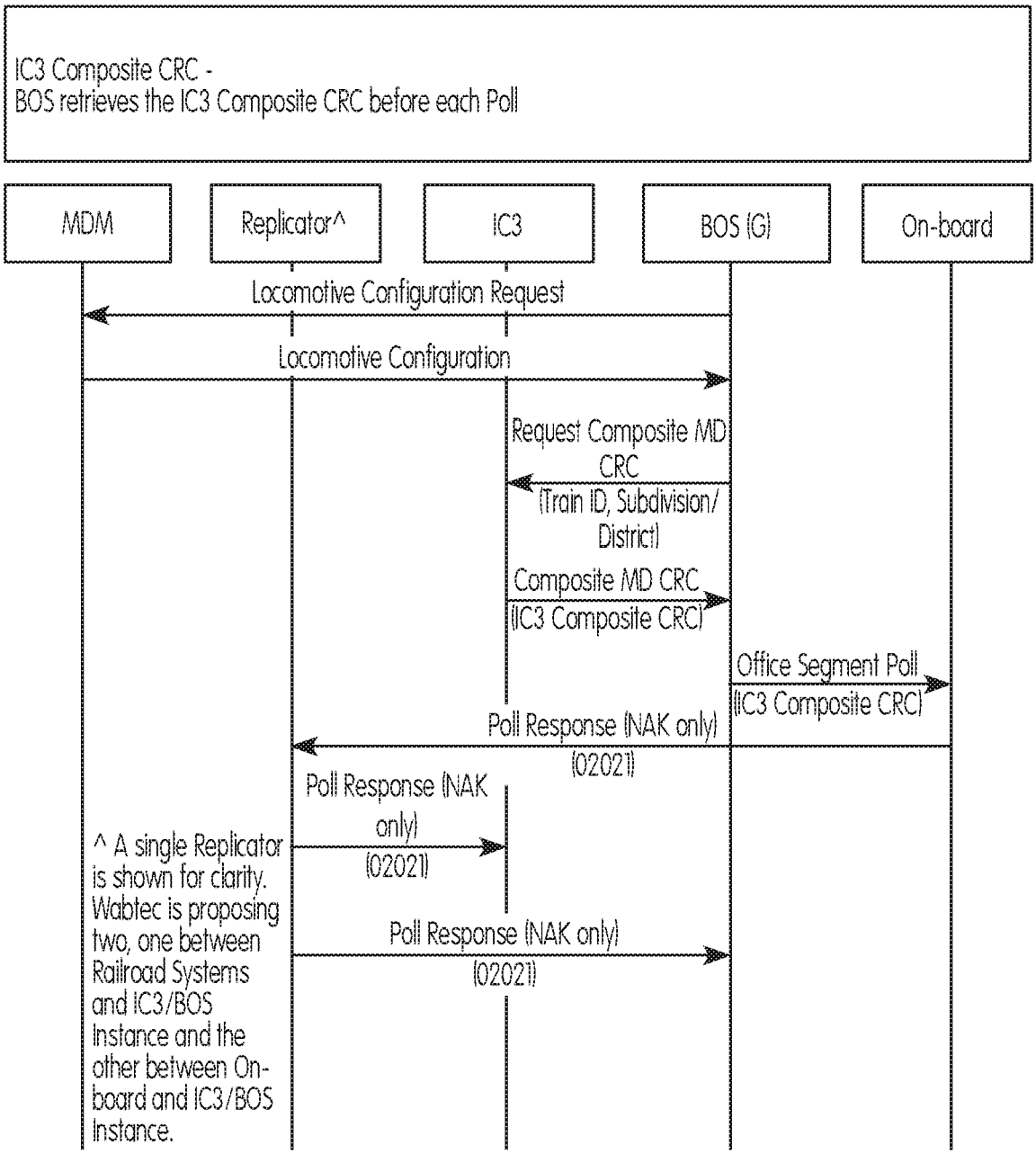
FIG. 4B is a signal/data flow chart illustrating a BOS retrieval of an IC3 Composite CRC before each poll.

FIG. 4A is a flow chart illustrating a method using composite CRC challenge mitigation according to an embodiment. With respect to a composite CRC that is an IC3-generated composite, the IC3 may generate the IC3 composite CRC. In other embodiments, a different checksum system generates a different CRC. The IC3 Composite CRC may be added to the polling process and used as a requirement for the on-board system to be synchronized with the G BOS. FIG. 4B is a signal/data flow chart illustrating a back office retrieval of an IC3 Composite CRC before each poll.

During operation, the IC3 may determine the IC3 composite CRC for each vehicle group for each subdivision/district of the PVC system. The IC3 receives each message sent to a G BOS and each message sent from a G BOS from the replicator. The IC3 may include each enforceable instruction CRC stored for a vehicle group in the IC3 Composite CRC for a subdivision district. In this embodiment, the IC3 Composite CRC may be determined or calculated based on the Vehicle group ID, the subdivision district name, the IC3 Authority CRCs, and the IC3 Bulletin CRCs.

The messages sent from the vehicles to the BOS or G BOS may include a uniqueness index. This index can have a value that is associated with or dependent on which vehicle in a vehicle group sent the message containing the uniqueness index. For example, different vehicles in a vehicle group may include uniqueness indices in the messages with values that are in a sequential order. This may involve a first vehicle in the vehicle group sending a uniqueness index of one, a second vehicle in the same vehicle group sending a uniqueness index of two, a third vehicle in the same vehicle group sending a uniqueness index of three, and so on. Optionally, other values may be used such that the order of the values in the uniqueness index sent by the vehicles in the same vehicle group are in a sequence and are not duplicated during a messaging cycle, during a trip of the vehicle group, until a reset of the system is performed, etc. The sequence of the uniqueness index values may not be based on the order in which the vehicles send the messages. For example, a message sent to or received by the BOS or GBOS may have a uniqueness index value that is greater than a later message sent by another vehicle in the same vehicle group and/or that is smaller than an earlier message sent by another vehicle in the same vehicle group. The order or sequence of the uniqueness index values may not necessarily be indicative of the order or sequence in which the associated messages are sent or received.

The BOS or G BOS can use the uniqueness index values that are received to determine whether messages are received from all vehicles in the vehicle group (or at least all vehicles having a control system, processors, a controller, etc. in the vehicle group), or whether messages were not received from one or more of the vehicles. If the BOS or G BOS examines the values of the uniqueness indices of the messages received from the vehicles and determines that one or more values in the sequence are missing, then the BOS or G BOS can determine that one or more vehicles did not send a message. This can indicate that this vehicle or these vehicles did not receive a bulletin or other information from the BOS or G BOS. Similarly, if multiple messages are received having the same uniqueness index value, then the BOS or G BOS can disregard or discard one or more of the messages (e.g., the older one or ones of the messages).

An example IC3 Composite CRC may represent the set of all bulletins and authorities that are associated with a vehicle group for a subdivision/district. The IC3 composite CRC may be determined or calculated over data received from vehicle control systems that IC3 converts to a neutral format. The format that the IC3 may use may not be the same as the BOS normalized format. Because the IC3 parses vehicle control systems messages, the IC3 is different for each vehicle control system. For example, formats may differ from one railroad to another even as locomotives move across routes of plural railroads. The IC3 Composite CRC may be determined or calculated using the IC3 generated individual MD CRCs described above. The IC3 Composite CRC may be determined or calculated over the individual MD CRCs for an enforceable instruction stored for a vehicle group for a subdivision/district. To determine or calculate the IC3 composite CRC, the IC3 may use the individual MD CRCs along with message data needed to associate an enforceable instruction with specific vehicle groups. To have the necessary message data, the IC3 receives messages sent to the G BOS from the on-board system and vehicle control systems, as well as messages sent from the G BOS to the on-board system and vehicle control systems.

During the G BOS/on-board polling process, the G BOS requests IC3 composite CRCs for a vehicle group by subdivision/district from the IC3 and sends the IC3 composite CRCs to the vehicle group. The IC3 receives the Request Composite CRC message from the G BOS. When the IC3 receives the request composite CRC message, the IC3 calculates an IC3 composite CRC for each vehicle group for each subdivision/district requested. The IC3 populates the IC3 composite CRC message with the IC3 composite CRC for the requested vehicle group ID and each requested subdivision/district. When the IC3 receives the synchronization request message from the G BOS for a subdivision/district the IC3 discards enforceable instruction data associated with the subdivision/district identified in the message. The synchronization request message is a G BOS—dispatch system message that may be replicated to the IC3.

Verification of an IC3 composite CRC is an additional consideration for the on-board system to maintain synchronization with the G BOS for a subdivision/district. If there is a mismatch between the G BOS and the IC3 association of an enforceable instruction with a vehicle group, the IC3 composite CRC calculated by the on-board system is determined to not match the IC3 composite CRC received in the message.

Figure 4C:
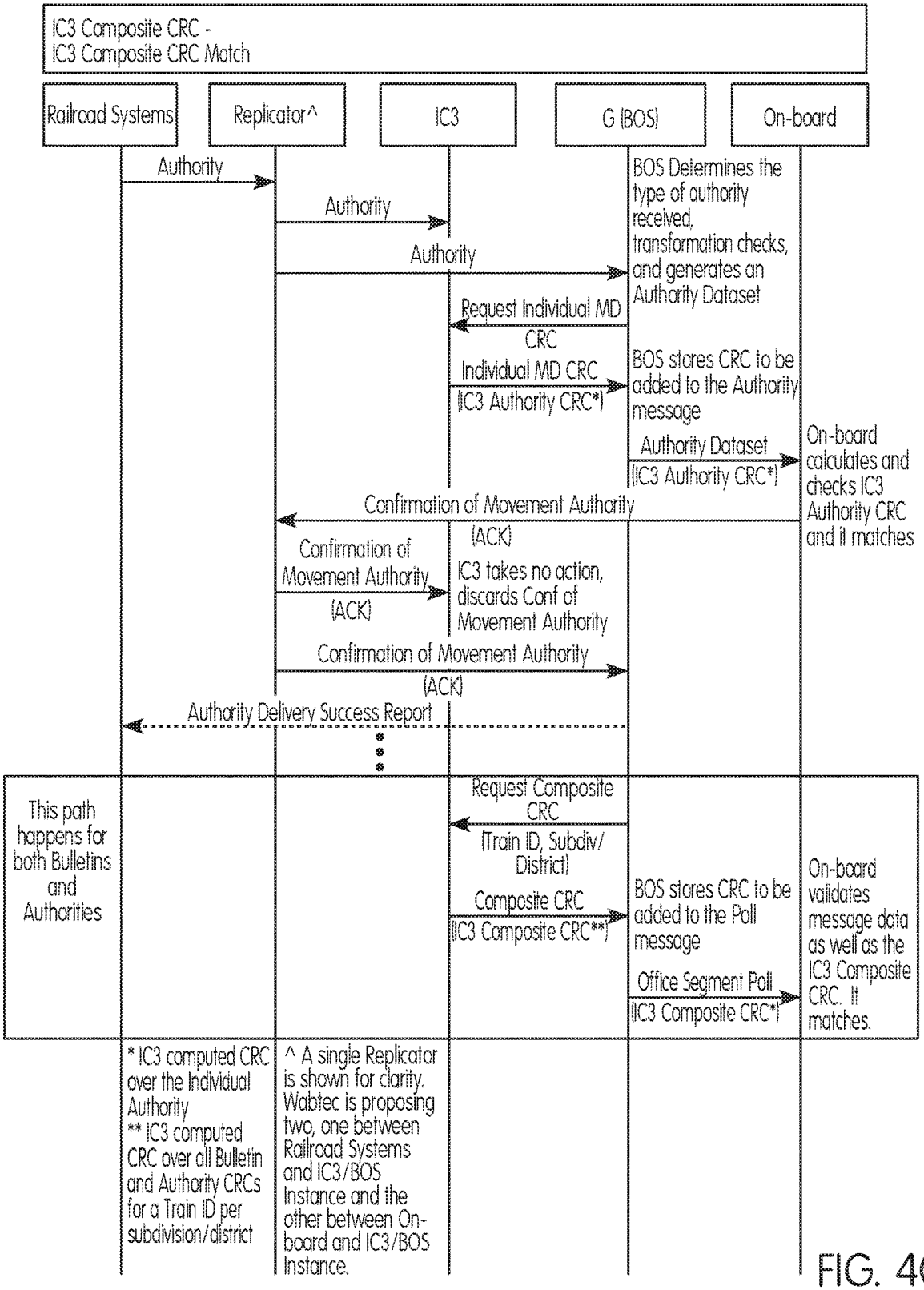
FIG. 4C is a signal/data flow chart illustrating a composite CRC match according to an embodiment.

Still referring to FIG. 4A, a method and system including IC3 composite CRC verification according to an embodiment may address, reduce, eliminate and/or mitigate challenges associated an enforceable instruction with vehicle groups. For example, the on-board system may verify plural separate CRCs created by separate processes using dissimilar logic (i.e., a dataset CRC calculated by the G BOS and an IC3 composite CRC calculated by IC3). When the calculated CRCs match the received CRCs, there is a statistically significant probability (probability MD set is correct=1−probability (corrupted message results in two dissimilar 32-bit CRCs being valid)) that the set of an enforceable instruction on-board is correct. FIG. 4C is a signal/data flow chart illustrating a composite CRC match according to an embodiment. When one of the calculated CRCs does not match the corresponding received CRC, the on-board system sets the associated subdivision/district to non-synchronized and may use non-synchronized behavior.

Figure 5A:
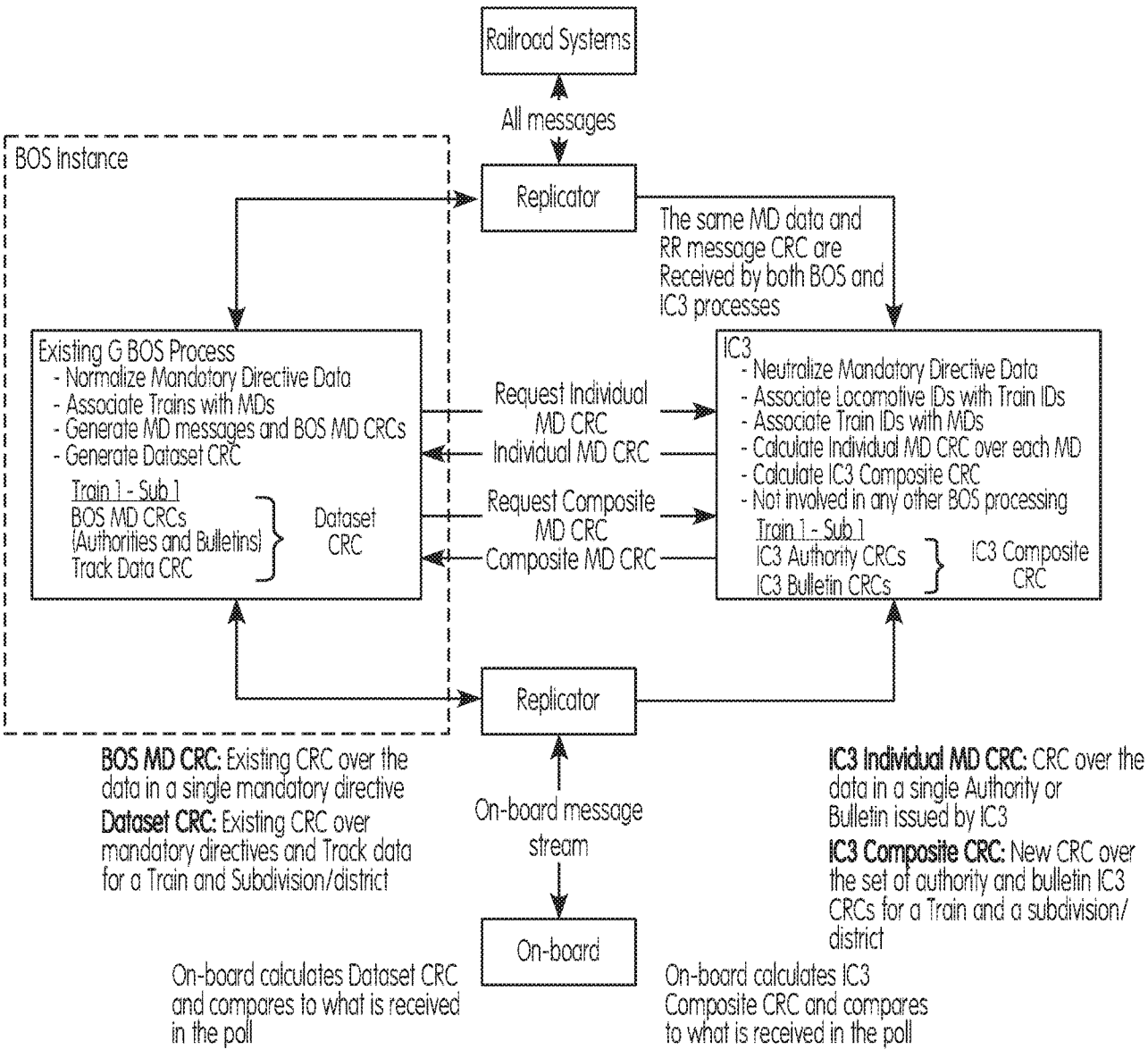
FIG. 5A is a flow chart illustrating a method and system for transmitting an enforceable instruction in positive vehicle control (PVC) systems according to an embodiment.

FIG. 5A is a flow chart illustrating a method for transmitting an enforceable instruction in PVC systems according to an embodiment. In this embodiment, the individual and composite CRC calculator (IC3) is a software-enabled process that receives enforceable instruction related messaging both from vehicle control systems and the on-board system. The IC3 receives vehicle control systems and locomotive messages exchanged with a G BOS through message replicators. When the IC3 receives an enforceable instruction from vehicle control systems the IC3 may generate the appropriate individual MD CRC for the enforceable instruction. The IC3 may use the individual MD CRC to update the IC3 composite CRC for the associated vehicle group(s) and subdivision/district(s).

Figure 5B:
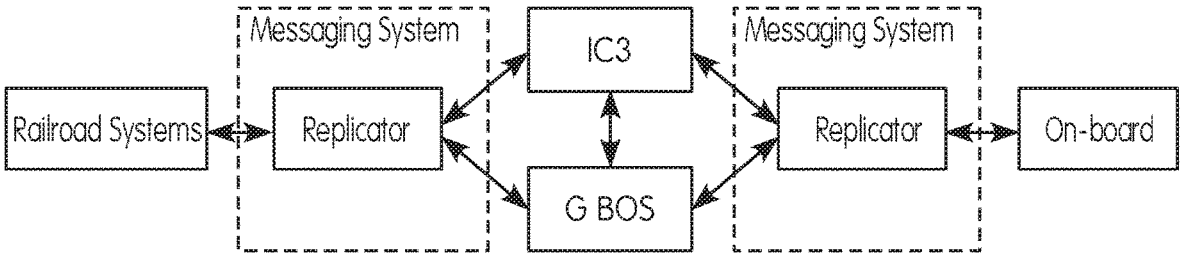
FIG. 5B is a block diagram illustrating a replicator according to an embodiment.

FIG. 5B is a block diagram illustrating a replicator according to an embodiment. The replicator is configured to replicate incoming and outgoing G BOS messages to IC3, as shown in FIG. 5B. Messages exchanged directly between IC3 and G BOS are not replicated nor are they passed through the replication function. The message replication function does not filter or modify messages. Depending on a railroad's messaging infrastructure, the replicator may be integrated into the messaging system, or it may be a separate process that is associated with a single IC3 and G BOS pair. There may be two replicator may process, one for on-board communication and one for vehicle control systems communication. If the replicator fails to deliver enforceable instruction related messages to either IC3 or G BOS, the G BOS calculated dataset CRC or IC3 calculated IC3 composite CRC may be determined to be incorrect by the on-board system.

In this embodiment, the IC3 may connect to the replicator via a class D interface. When the IC3 receives replicated messages, the IC3 validates that the message is not corrupt using the RR message CRC for vehicle control systems—G BOS messages or the HMAC for G BOS—on-board messages. The IC3 does not duplicate the extensive BOS message validation process but does validate fields used for calculating the Individual MD CRCs. When the IC3 determines that a message is invalid, the IC3 discards the message. The IC3 stores information from specified messages. The IC3 may use the message information to maintain associations between vehicle group IDs and an enforceable instruction, associations between vehicle group IDs and vehicle IDs, and a determination if an enforceable instruction is required to be stored on-board. The IC3 may use the messages received from the on-board system to generate a vehicle group ID to vehicle ID association, as well as to determine the result of crew action for authorities (e.g., acknowledge/accept/reject). The IC3 ignores a message that is not required for determining which an enforceable instruction should be on-board. The IC3 stores information in its own storage facility (e.g., a database) that is not accessible by G BOS. The IC3 stores the following vehicle control system—G BOS message information: Authorities, Bulletins, Authority May void, and Bulletin May void/Cancels. The IC3 stores the following G BOS—on-board system message information: poll registration (vehicle group ID to vehicle ID association) and crew acknowledgement of enforceable instruction status (stored for authority acknowledge/accept/reject, but not for bulletins). The IC3 may monitor the G BOS—vehicle control systems messages via a replicator and may use the Synchronization Request message from G BOS to trigger the discarding of all enforceable instruction data associated with the subdivision/district received in the message.

When the G BOS receives an enforceable instruction, such as from a vehicle control system, the G BOS may process the message using conventional BOS processing methods. The G BOS requests and waits for receipt of the Individual MD CRC prior to constructing and transmitting an enforceable instruction message to be sent to the on-board system. When issuing a poll to a vehicle group, the G BOS requests and waits for the IC3 Composite CRCs from IC3 for the vehicle group and subdivisions/districts to be included in the poll.

In another embodiment, an assurance concept may be a diversity and self-checking process implemented using self-check code. Incorporation of the individual MD CRC data by the BOS may create enforceable instruction messages and the addition of the IC3 composite CRC in the polling process enable the on-board segment using a process of verifying that received data is correct and complete. Unique data sets (normalized versus neutralized), separate design specifications, and interface control documents (ICDs) may allow for the creation of diverse implementations.

Accordingly, a method and system for transmitting an enforceable instruction in PVC systems may include a process to calculate an IC3 composite CRC representing an enforceable instruction associated with a vehicle group for a subdivision/district and an individual MD CRC for each enforceable instruction; an IC3 composite CRC field to the office segment poll (01021) message; and a poll response (02021) message for the on-board to send to the G BOS in response to an office segment poll (01021) message. The poll response message can be used to indicate an IC3 composite CRC mismatch after a second office segment poll (01021) message is received by the on-board and the IC3 Composite CRC is still mismatched (NAK only). Optionally, the poll response message can include the uniqueness index described above. On-board processing of the office segment poll (01021) message may be updated, and verification of the IC3 composite CRC and generation of the poll response (02021) message may be included. A messaging interface between G BOS and IC3 is provided. A process to replicate messages exchanged between vehicle control systems and G BOS and between G BOS and on-board is provided. Replication may be bidirectional to and from vehicle control systems, and to and from the on-board system. Error code(s), event(s), and CFG(s) may be provided by the G BOS to trigger a BOS action for subdivisions/districts based on the content received in a Poll Response (02021) message, the Confirmation of Movement Authority (02052) message, confirmation of movement authority void (02053) message, confirmation of bulletin dataset (02042) message, and the confirmation of bulletin cancellation (02043) message. The CFG may include configuration data, such as a listing of relevant equipment, software versions, and the like.

An IC3 instance may be provided for each G BOS process in a PVC system. The IC3 maintains a database of all currently issued bulletins and authorities and their individual MD CRCs for the subdivision/district that the G BOS controls. The IC3 may associate bulletins and authorities with vehicle groups based on the content of the enforceable instruction messages received from vehicle control systems and calculates the IC3 Composite CRCs for each vehicle group. The IC3 may use the stored enforceable instruction data and associations to calculate the Individual MD CRCs (for each enforceable instruction) and the IC3 Composite CRC (for each vehicle group and subdivision/district). IC3 provides the individual MD CRCs and IC3 composite CRC to G BOS through a messaging interface.

Existing vehicle group control segments may be modified to implement the IC3 individual and composite CRC designs. For example, individual and composite CRC calculator (IC3) applications may be included in a BOS instance, e.g., one application for each G BOS process. A message replicator function may be included, one between vehicle control systems and BOS and one between on-board and BOS. The message replicator function(s) replicates all messages between respective communication parties via Class D link (no filtering) as discussed above with respect to FIG. 5B. A Class D link may be included for the interface between IC3 and the G BOS.

For movement authority in an individual CRC implementation, an IC3 Authority CRC field may be included in the Movement Authority Dataset (01051) message. The G BOS populates this field with the IC3 Authority CRC. The G BOS has no knowledge of how this CRC may be determined or calculated, as it acts merely as a pass-though. An enumeration may be included in the Acknowledgement Indication field in the Confirmation of Movement Authority (02052) message. This value indicates IC3 Authority CRC mismatch: NAK—Failed IC3 authority CRC check. An error code, event, and configurable BOS action may be included to trigger on the new NAK value in the 02052 message. A field may be included in the Movement Authority Void (01053) message to transmit the IC3 Authority Void CRC over the authority void to the on board. Again, the G BOS has no knowledge of how this CRC may be determined or calculated. An enumeration may be included in the Acknowledgement Indication field in the Confirmation of Movement Authority Void (02053) message. This value may indicate IC3 Authority Void CRC mismatch: NAK—Failed IC3 authority void CRC check. An error code, event, and configurable BOS action may be included to trigger on the new NAK value in the 02053 message.

For Bulletins in an individual CRC implementation, an IC3 Bulletin CRC field may be included in the Bulletin Dataset (01041) message. The G BOS populates this field with the IC3 Bulletin CRC. As discussed, the G BOS may have no knowledge of how this CRC has been determined or calculated. An enumeration may be included in the Acknowledgement Indication field in the Confirmation of Bulletin Dataset (02042) message to indicate IC3 Bulletin CRC mismatch: NAK—Failed IC3 bulletin CRC check. An error code and event in the BOS may be included to trigger an existing dispatch system-BOS configurable action for the subdivision/district(s) identified in the 02042 message. A BOS CFG may be included to let customers pick a BOS action for the subdivision/district(s) when either the Individual MD CRC or IC3 Composite CRC fails validation. A field in the Bulletin Cancellation (01043) message to transmit the IC3 Bulletin Void CRC over the voided bulletin item to the on-board. As the G BOS has no knowledge of how this CRC may be determined or calculated, an enumeration may be included in the Acknowledgement Indication field in the Confirmation of Bulletin Cancellation (02043) message to indicate IC3 Bulletin Void CRC mismatch: NAK—Failed IC3 bulletin void CRC check. An error code and event may be included in the BOS to trigger an existing dispatch system-BOS configurable action for the subdivision/district(s) identified in the 02043 message.

For a Composite CRC Implementation, a Poll Response (02021) message may be included to respond to a G BOS Office Segment Poll (01021) message when a second IC3 Composite CRC mismatches. An IC3 Composite CRC field may be included in the Office Segment Poll (01021) message for the G BOS to populate directly with the IC3 Composite CRC that it requests from IC3 before every poll message. An error code and event may be included in the BOS to trigger an existing IC3-BOS configurable action (UB1 or UB2) for the subdivision(s) identified in the Poll Response (02021) message when the IC3 Composite CRC does not match as determined by the on-board.

The IC3 may be programmed or configured to support a single G BOS process. The IC3 may be subject to the same performance and availability guidelines as required of a G BOS process (for receiving/processing messages). The IC3 may be configured with definitions of class D connections to replicators and one or more G BOS specifications. In one embodiment, the IC3 may use a locomotive OPK for authenticating messages between G BOS and on-board. The IC3 may be programmed or configured to attempt to correct a connection problem with BOS or the replicator by retrying the connection per the class D configuration settings. The IC3 does not directly correct or report failures. When the IC3 detects a validation error in a message the IC3 discards the message and the IC3 Composite CRC may be determined or calculated without the data received in the message. This results in determined behavior by the on-board system.

The IC3 logs data in one or more CSV files. The IC3 logs the receipt of all messages with the following information: Message Source, Receipt Time, and Message Number. The IC3 logs additional information for messages that contain data that is stored including Message Data, Message CRC, and Message Validity. The IC3 logs the following information: Individual MD CRCs calculation results, IC3 Composite CRC calculation results, Vehicle group ID to Vehicle ID associations, and enforceable instruction to Vehicle group ID/Vehicle ID associations.

The BOS may include an interface for IC3 messaging and behaviors for sending the Request Individual MD CRC message and receiving the Individual MD CRC message, including retries. The BOS may populate the Movement Authority Dataset (01051) message with the IC3 Authority CRC, include requirement(s) to act on a NAK in the Confirmation of Authority Dataset (02052) message with the new event (based on CFG), populate the Movement Authority Void (01053) message with the IC3 Authority Void CRC, include requirement(s) to respond to a NAK in the Confirmation of Movement Authority Void (02053) message with the new event (based on CFG), populate the Bulletin Dataset (01041) message with the IC3 Bulletin CRC, include requirement(s) to respond to a NAK in the Confirmation of Bulletin Dataset (02042) message with the new event (based on CFG), populate the Bulletin Cancellation (01043) message with the IC3 Bulletin Void CRC, and include requirement(s) to respond to a NAK in the Confirmation of Bulletin Cancellation (02043) message with the new event (based on CFG), include a new event to log and notify per railroad direction.

A BOS requesting an IC3 Composite CRC may include an interface for IC3 messaging and behaviors for sending the Request Composite CRC message and receiving the Request Composite CRC message, including retries, populate the Office Segment Poll (01021) message with the IC3 Composite CRC, include behaviors in response to the Poll Response (02021) NAK message based on message content and configuration settings, and include logging of IC3 messages to the existing BOS message logging functions.

In another embodiment, the BOS connects via a class D connection to the IC3. If there is a connection problem, BOS retries the connection per the configured class D settings for the connection. Before the G BOS issues an enforceable instruction to on-board, the G BOS requests the associated IC3 Individual MD CRC from IC3. When the G BOS receives the IC3 Individual MD CRC, the G BOS sends the enforceable instruction message to the on-board system. If the G BOS does not receive the IC3 Individual MD CRC the G BOS does not send the enforceable instruction message to on-board system. Before the G BOS polls an on-board, the G BOS requests the IC3 Composite CRC for each subdivision/district for the associated vehicle group ID. When the G BOS receives the IC3 Composite CRC and meets all other existing polling conditions, the G BOS adds the IC3 Composite CRC to the Office Segment Poll (01021) message. If the G BOS does not receive the IC3 Composite CRC the G BOS does not send the Office Segment Poll (01021) message.

The G BOS receives the new Poll Response (02021) message. The message has a Status bit field indicating which fields in the message match the fields in the last sent Office Segment Poll (01021) message. When the G BOS is in Explicit control mode for a subdivision/district and the Status field in the Poll Response (02021) message for that subdivision/district indicates that the Dataset CRC matches and the IC3 Composite CRC does not match, the BOS takes the configured action (only UB1 or UB2 are allowed), associated with an event number. The G BOS ignores the Poll Response (02021) message when not in Explicit Control Mode.

A new numbered event and CFG may be added for the BOS to perform configurable behavior (UB1 or UB2) when the BOS receives a Poll Response (02021) message from the on-board system with the Status field indicating a matched Dataset CRC and mismatched IC3 Composite CRC. A new numbered event may be added to BOS when IC3 does not respond to a Request Individual MD CRC message with a valid Individual MD CRC message. A new numbered event may be added to BOS when IC3 does not respond correctly to a Request Composite CRC message. A new CFG may be added to configure the BOS to interface with the IC3.

The on-board system is updated to verify each of the IC3 generated CRCs and provide the appropriate response to the G BOS when a CRC mismatch is detected. The on-board system is updated to verify the IC3 Authority CRC when the on-board system receives a Movement Authority Dataset (01051) message from the G BOS. The on-board system calculates the IC3 Authority CRC based upon the data within the Movement Authority Dataset (01051) message. The on-board system compares the on-board calculated IC3 Authority CRC to the IC3 Authority CRC received within the Movement Authority Dataset (01051) message. If the on-board system calculates an IC3 Authority CRC that matches the IC3 Authority CRC received in the message in addition to existing verification items, the on-board segment sends the Confirmation of Movement Authority (02052) message with a positive acknowledgement to the G BOS. If the on-board system calculates an IC3 Authority CRC that does not match the IC3 Authority CRC received in the message, the on-board system sets the associated subdivision/district to non-synchronized and sends the Confirmation of Movement Authority (02052) message with a negative acknowledgement to the G BOS indicating the mismatch. The Movement Authority Dataset (01051) and Confirmation of Movement Authority (02052) messages are updated.

The on-board system may update to verify the IC3 Authority Void CRC when the on-board system receives a Movement Authority Void (01053) message from the G BOS. The on-board system calculates the IC3 Authority Void CRC based upon the data within the Movement Authority Void (01053) message. The on-board system compares the on-board calculated IC3 Authority Void CRC to the IC3 Authority Void CRC received within the Movement Authority Void (01053) message. If the on-board system calculated IC3 Authority Void CRC matches the IC3 Authority Void CRC in addition to existing verification items, the on-board system sends the Confirmation of Movement Authority Void (02053) message with a positive acknowledgement to the G BOS. If the on-board calculated IC3 Authority Void CRC does not match the IC3 Authority Void CRC received in the message, the on-board system sets the associated subdivision/district to non-synchronized and sends the Confirmation of Movement Authority Void (02053) message with a negative acknowledgement to the G BOS indicating the mismatch. The Movement Authority Void (01053) and Confirmation of Movement Authority Void (02053) messages are updated.

The on-board system may be updated to verify the IC3 Bulletin CRC when the on-board system receives a Bulletin Dataset (01041) message from the G BOS. The on-board system calculates the IC3 Bulletin CRC based upon the data within the Bulletin Dataset (01041) message. The on-board system compares the on-board calculated IC3 Bulletin CRC to the IC3 Bulletin CRC received within the Bulletin Dataset (01041) message. If the on-board calculated IC3 Bulletin CRC matches the IC3 Bulletin CRC received in the message in addition to existing verification items, the on-board system sends the Confirmation of Bulletin Dataset (02042) message with a positive acknowledgement to the G BOS. If the on-board system determines an IC3 Bulletin CRC does not match the IC3 Bulletin CRC received in the message, the on-board system may respond by flagging the associated subdivision/district as being non-synchronized and may send the Confirmation of Bulletin Dataset (02042) message with a negative acknowledgement to G BOS indicating the mismatch. The Bulletin Dataset (01041) and Confirmation of Bulletin Dataset (02042) messages are updated.

The on-board system is updated to verify the IC3 Bulletin Void CRC when the on-board system receives a Bulletin Cancellation (01043) message from the G BOS. The on-board system calculates the IC3 Bulletin Void CRC based upon the data within the Bulletin Cancellation (01043) message. The on-board system compares the on-board calculated IC3 Bulletin Void CRC to the IC3 Bulletin Void CRC received within the Bulletin Cancellation (01043) message. If the on-board calculated IC3 Bulletin Void CRC matches the IC3 Bulletin Void CRC received in the message in addition to existing verification items, the on-board segment sends the Confirmation of Bulletin Cancellation (02043) message with a positive acknowledgement to the G BOS. If the on-board system calculates an IC3 Bulletin Void CRC that does not match the IC3 Bulletin Void CRC received in the message, the on-board system sets the associated subdivision/district to non-synchronized and sends the Confirmation of Bulletin Cancellation (02043) message with a negative acknowledgement to the G BOS indicating the mismatch. The Bulletin Cancellation (01043) and Confirmation of Bulletin Cancellation (02043) messages are updated.

The on-board system may be updated to verify the IC3 Composite CRC and send the Poll Response (02021) message as part of the polling process. The on-board system calculates a matching IC3 Composite CRC in addition to meeting all existing conditions to be synchronized with the G BOS for a subdivision/district. The on-board system sends the Poll Response (02021) message upon receiving an Office Segment Poll (01021) message for which the on-board system detects a CRC mismatch. When the on-board system receives a valid Office Segment Poll (01021) message and all CRCs in the message match, no action is required. When the G BOS reports that it is in Non-Explicit control or Synchronize mode, the existing on-board behavior remains unchanged and the IC3 Composite CRC is not checked. The on-board system does not validate the IC3 Composite CRC while the G BOS is in Synchronize mode because the set of an enforceable instruction stored by the G BOS and the IC3 may be changing throughout the synchronizing process. The on-board system does not validate the IC3 Composite CRC while the G BOS is in Non-Explicit control mode because the G BOS does not issue more permissive authorities in this mode and the IC3 does not include logic to determine permissiveness of an authority.

In one embodiment, when the on-board system receives a valid Office Segment Poll (01021) message and the G BOS reports that it is in Explicit control mode the on-board system checks the IC3 Composite CRC in addition to the Dataset CRC for determining synchronization status. The on-board system verifies the Dataset CRC and the IC3 Composite CRC. The on-board system verifies the Dataset CRC and synchronizes datasets with the G BOS per current functionality. After the calculated Dataset CRC matches the received Dataset CRC, the on-board system calculates the IC3 Composite CRC for the associated subdivision/district. The on-board system calculates the IC3 Composite CRC using the IC3 Authority CRCs received in Movement Authority Dataset (01051) messages and IC3 Bulletin CRCs received in Bulletin Dataset (01041) messages. The on-board system may compare the calculated IC3 Composite CRC to the IC3 Composite CRC received within the Office Segment Poll (01021) message. If the calculated IC3 Composite CRC does not match the received IC3 Composite CRC, the on-board system sends a Poll Registration (02020) message requesting another Poll message for the subdivision/district. When the on-board system receives a second Office Segment Poll message and the on-board calculated IC3 Authority CRC still does not match, the on-board system sets the subdivision to non-synchronized and sends the Poll Response (02021) message with a negative acknowledgment to the G BOS indicating the mismatch. When the calculated IC3 Composite CRC matches the IC3 Composite CRC received in the Office Segment Poll (01021) message, the on-board system continues normal operation. If all existing conditions for synchronization are met in addition to the IC3 Composite CRC match, the on-board system sets the subdivision/district to synchronized.

The Office-Locomotive ICD may be modified to add the IC3 Authority CRC field to the Movement Authority Dataset (01051) message and update the enumeration in the Confirmation of Authority Dataset (02052) message to indicate an IC3 Authority CRC mismatch. The Office-Locomotive ICD may be modified to add the IC3 Authority Void CRC field to the Movement Authority Void (01053) message and update the enumeration in the Confirmation of Movement Authority Void (02053) message to indicate IC3 Authority Void CRC mismatch. The Office-Locomotive ICD may be modified to add the IC3 Bulletin CRC field to the Bulletin Dataset (01041) message and update the enumeration in the Confirmation of Bulletin Dataset (02042) message to indicate an IC3 Bulletin CRC mismatch. The Office-Locomotive ICD may be modified to add the IC3 Bulletin Void CRC field to the Bulletin Cancellation (01043) message and update the enumeration in the Confirmation of Bulletin Cancellation (02043) message to indicate an IC3 Bulletin Void CRC mismatch.

The Office-Locomotive ICD may be modified to add a new field to the Office Segment Poll (01021) message to a locomotive. The new field is Composite CRC for each PVC Subdivision/District loop. The Office-Locomotive ICD may contain the new Poll Response (02021) message sent from the on-board system to the G BOS upon receipt of the Office Segment Poll (01021) message.

Another challenge may be that after the on-board system receives an enforceable instruction, the on-board system transforms the provided milepost limit data to the block and offset data associated with the track database. The milepost limit data is an example of limits that may be included in an enforceable instruction. Other limit examples may include designated or determined locations that may be permanent, semi-permanent or dynamic/relational. There may be one or more associated and/or potential challenge to a successful transformation. The on-board system may introduce an error during limit transformation and correctly transformed limits may not be at the correct physical location.

Embodiments of the inventive system and method may mitigate error sources that may result in incorrect on-board transformation results: software errors, hardware errors, and track database errors. Software errors, including errors in requirements, implementation, and compilation may exist resulting in transformed enforceable instruction data pointing to incorrect location(s) within the track database. Triplex design may mitigate the second error source where random hardware faults result in an error in the enforceable instruction data transformation. The Triplex design, in conjunction with the cross channel comparison, detects an issue related to faulty hardware that could alter the results of the enforceable instruction data transformation. Another error source is that enforceable instruction data milepost limits may not be at the correct physical location. One mitigation approach requires each track database be validated for correctness prior to being used for PVC operation. The required validation ensures the locations of features in the track data match their physical location. Note that there has not been validation between vehicle control system dispatchable points and the track database and that each railroad is responsible for their own track validation. Each track database is protected by a CRC to ensure integrity while being transferred between different segments of the vehicle control system. Accordingly, transformation challenges may be mitigated by a design and verification process, triplex processor design, and track validation according to embodiments.

FIG. 5C is a table showing PVC systems behaviors according to one embodiment. FIG. 5C provides on-board and G BOS response to messages sent to the on-board system in example scenarios in a PVC system. The G BOS mode, Dataset CRC, IC3 Composite CRC, IC3 Authority or Void CRC, and IC3 Bulletin or Void CRC conditions for each scenario are provided.

Figure 6A:
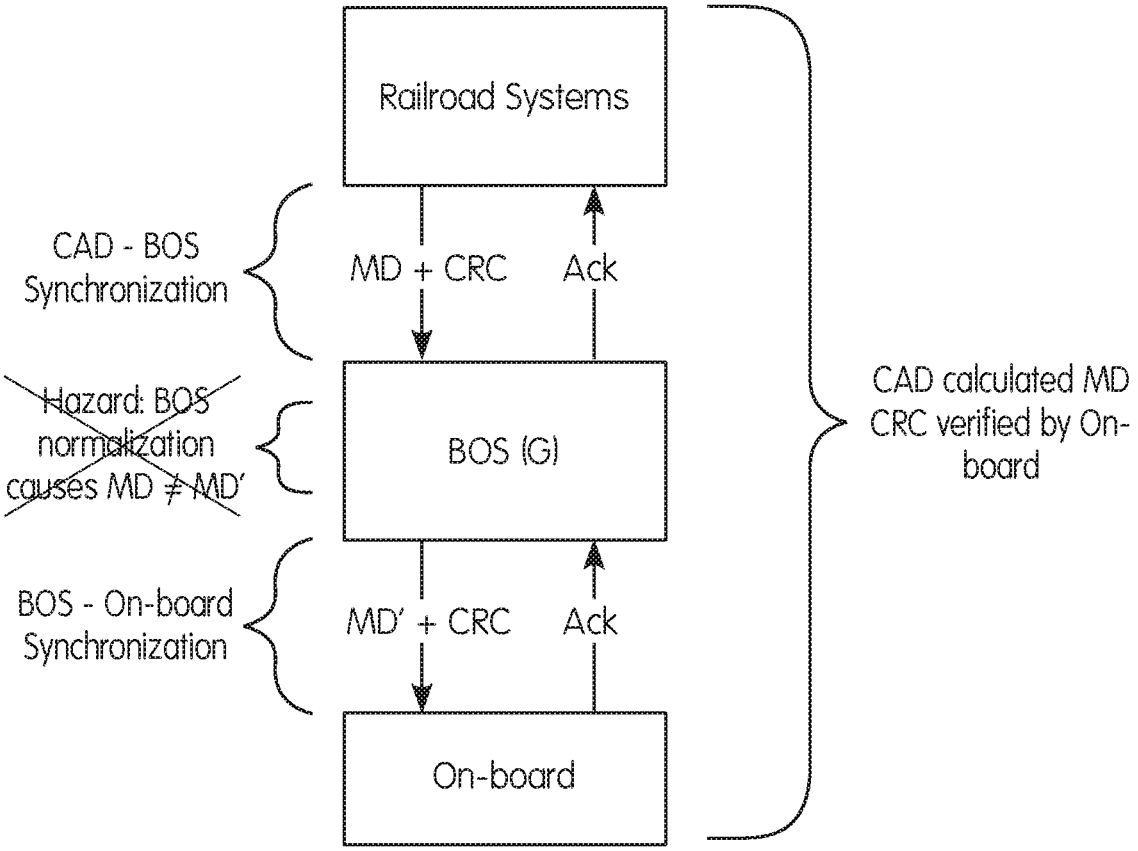
FIG. 6A is a flow chart illustrating a method and system for CRC challenge mitigation according to another embodiment.
Figure 6B:
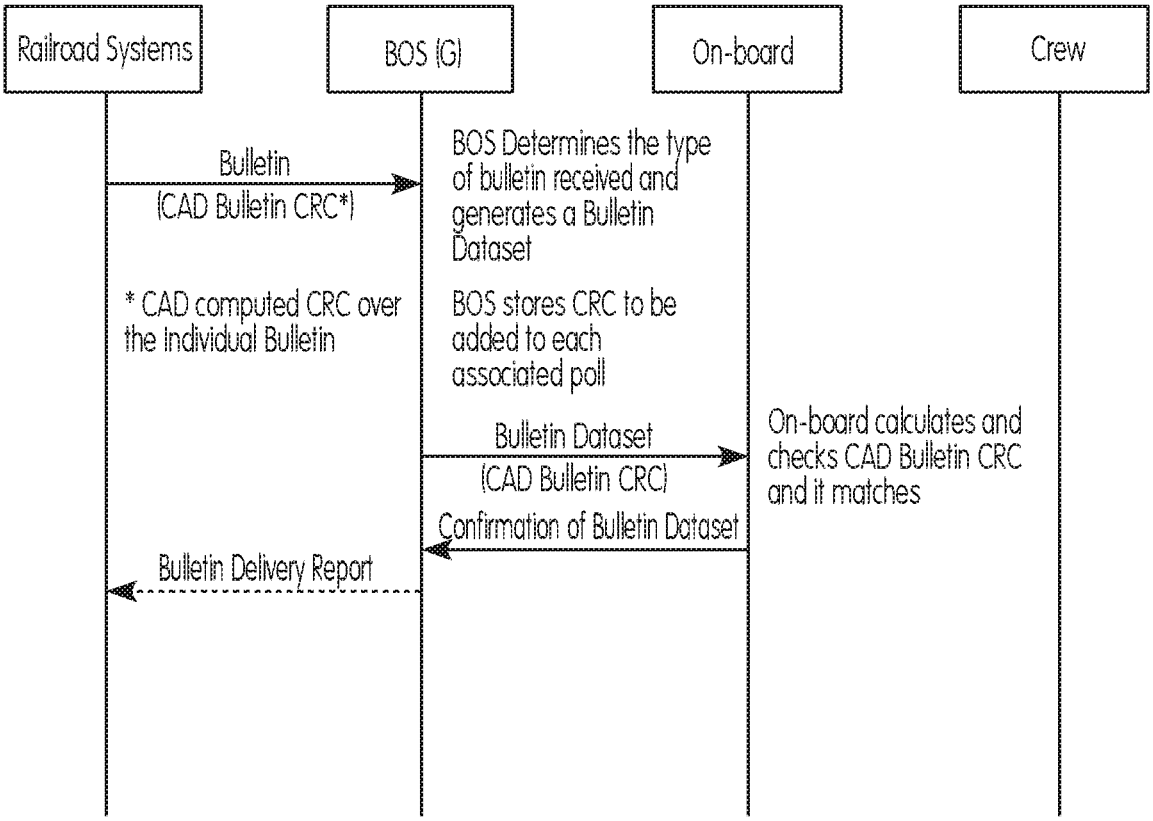
FIG. 6B is a signal/data flow chart illustrating a successful delivery of a bulletin according to an embodiment.
Figure 6C:
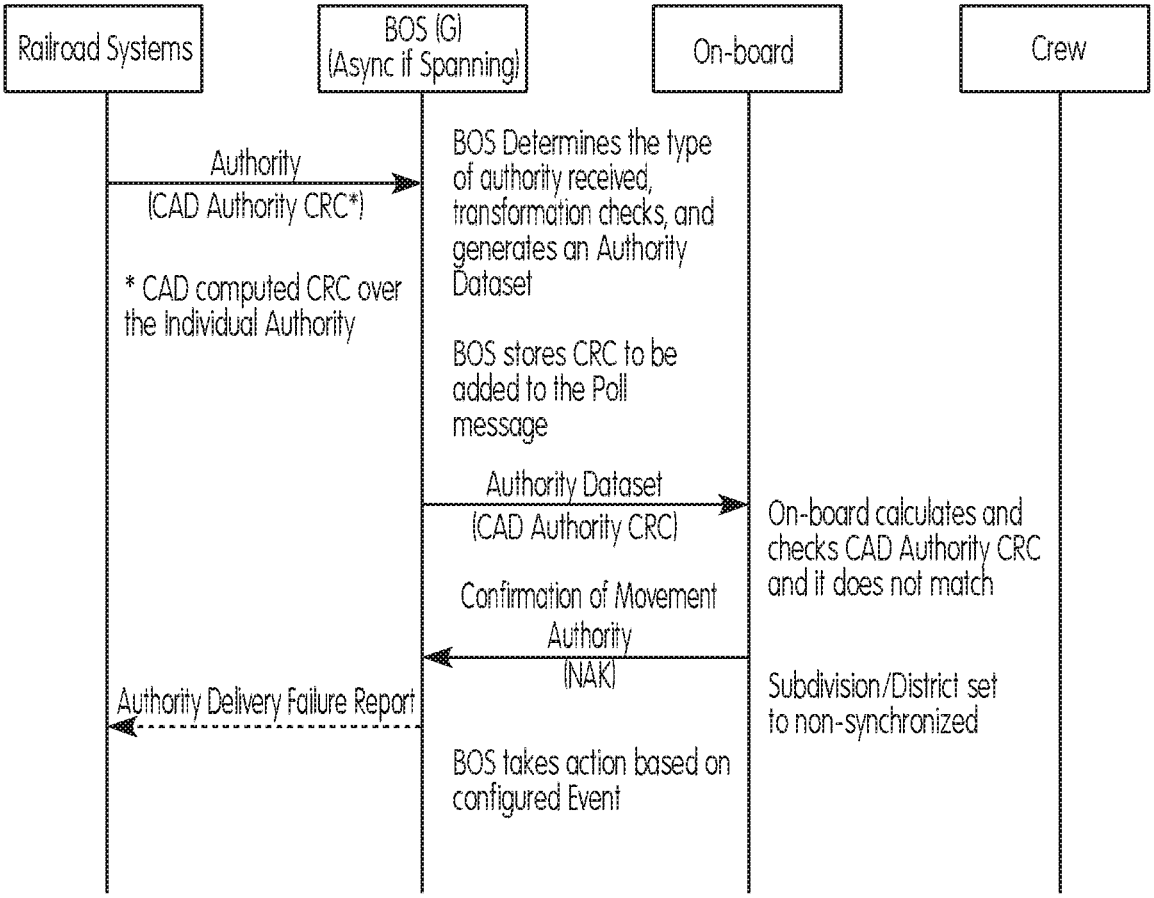
FIG. 6C is a signal/data flow chart illustrating an authority CRC mismatch according to an embodiment.

FIG. 6A is a flow chart illustrating a method for CRC challenge mitigation according to another embodiment. FIG. 6B is a signal/data flow chart illustrating a successful delivery of a bulletin according to an embodiment. FIG. 6C is a signal/data flow chart illustrating an authority CRC mismatch according to an embodiment. A dispatch system CRC method and system according to an embodiment is directed to normalization of enforceable instruction data, which provides an end-to-end (i.e. between the dispatch system and the PVC component on-board) verification of operational enforceable instruction set. The dispatch system provides enforceable instruction CRCs calculated over defined sets of operational enforceable instruction data. For example, four new CRCs are calculated and provided to the PVC system from the dispatch system, including: an authority data CRC (CAD Authority CRC), a bulletin data CRC (CAD Bulletin CRC), an authority void data CRC (CAD Authority Void CRC), and a bulletin void data CRC (CAD Bulletin Void CRC), collectively referred to as MD CRC(s). The dispatch system provides a MD CRC upon issuance of each enforceable instruction or void. The BOS passes the unaltered MD CRC to the on-board system within the enforceable instruction messages, and the on-board system verifies the enforceable instruction using the dispatch system-calculated MD CRC. The on-board system compares the dispatch system-calculated MD CRC to the equivalent on-board-calculated MD CRC when the associated enforceable instruction is received from the BOS. When the on-board-calculated MD CRC does not match the dispatch system-calculated MD CRC, the on-board system sends a message to the BOS and becomes non-synchronized for the subdivision associated with the mismatched MD CRC (FIG. 6C). When the BOS receives the message from the on-board system, it responds by initiating a determined action.

Figure 7:
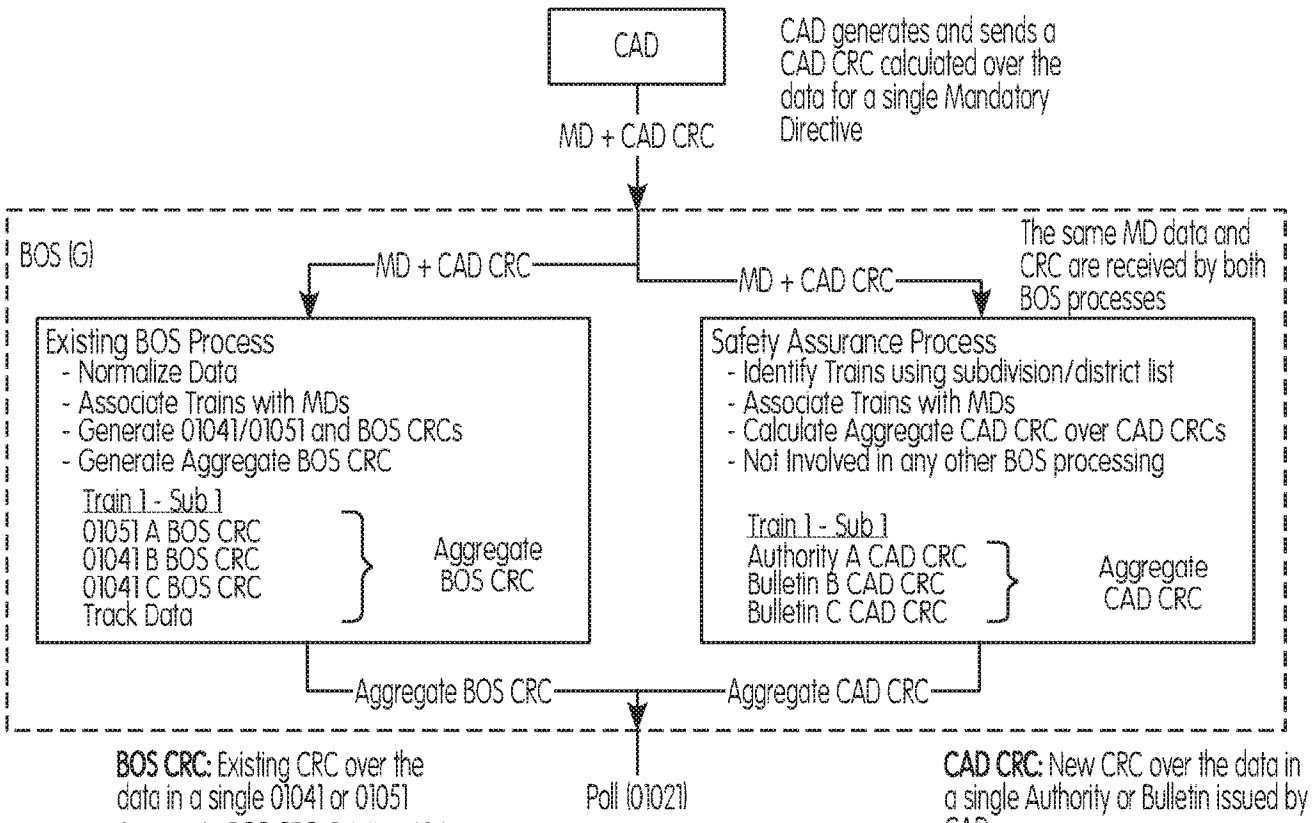
FIG. 7 is a flow chart illustrating a method and system for transmitting an enforceable instruction in PVC systems according to another embodiment.
Figure 8A:
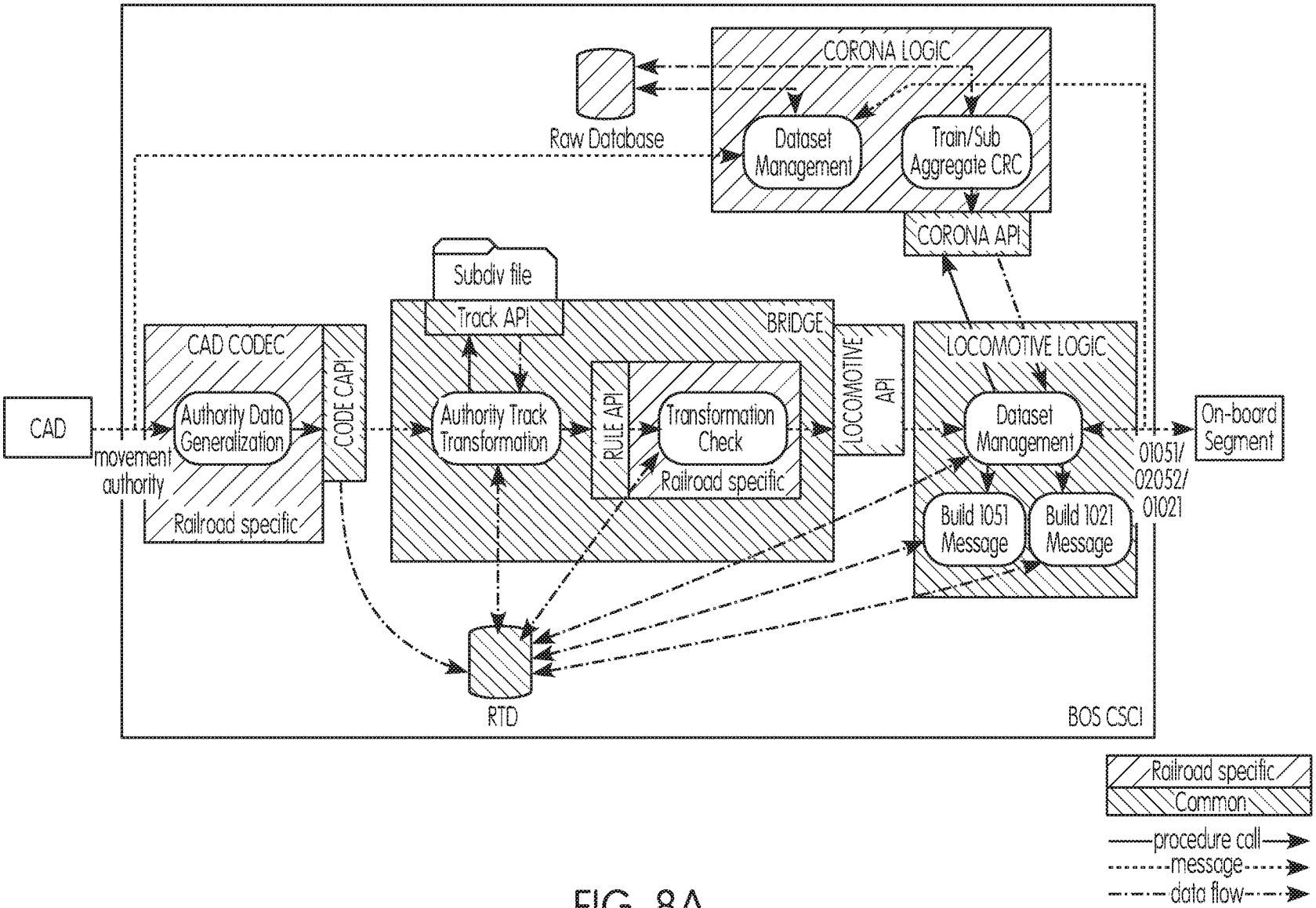
FIG. 8A is a block diagram of a system for transmitting an enforceable instruction in PVC systems according to another embodiment.
Figure 8B:
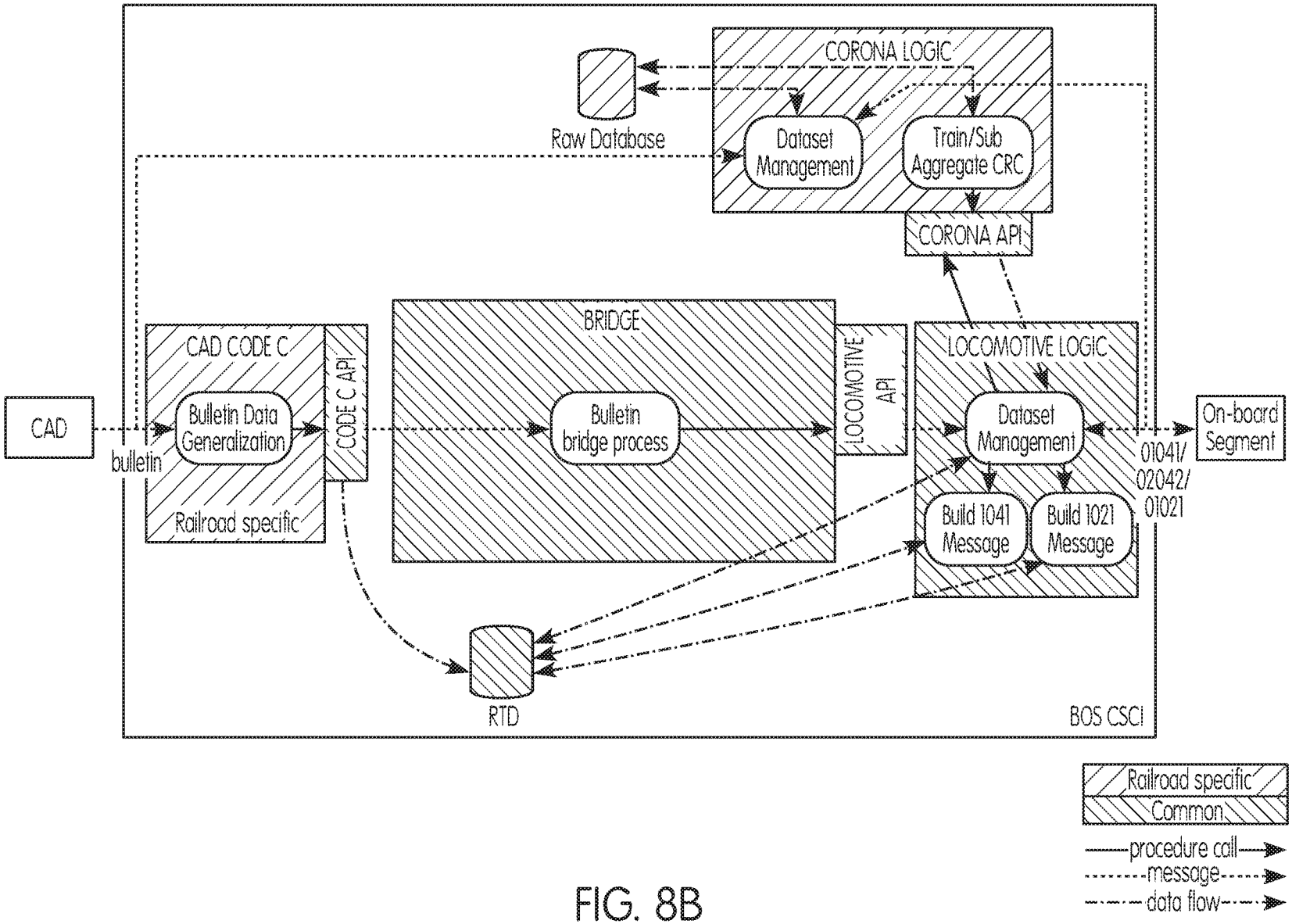
FIG. 8B is a block diagram of a system for transmitting an enforceable instruction in PVC systems according to an embodiment.

FIG. 7 is a flow chart illustrating a method for transmitting an enforceable instruction in positive vehicle control (PVC) systems according to another embodiment. A field is added to dispatch system authority messages to transmit the dispatch system Authority CRC over the authority from the dispatch system to the on-board system. The BOS has no knowledge of how this CRC may be determined or calculated. A dispatch system Authority CRC field is added to the Movement Authority Dataset (01051) message for the BOS to populate directly with the dispatch system Authority CRC. An enumeration to the Acknowledgement Indication field is added in the Confirmation of Movement Authority (02052) message to indicate dispatch system Authority CRC mismatch: NAK—Failed dispatch system authority CRC check. An error code and event are added in the BOS to trigger a dispatch system-BOS configurable action for the subdivision(s) identified in the 02052 message. A field is added to dispatch system bulletin message(s) to transmit the dispatch system Bulletin CRC over the bulletin from the dispatch system to the on-board system. The BOS may have no knowledge of how this CRC has been determined or calculated. A dispatch system Bulletin CRC field is added to the Bulletin Dataset (01041) message. An enumeration is added to the Acknowledgement Indication field in the Confirmation of Bulletin Dataset (02042) message to indicate dispatch system Bulletin CRC mismatch: NAK—Failed dispatch system bulletin CRC check. An error code and event are added in the BOS to trigger dispatch system-BOS sync or stop for the subdivision(s) identified in the 02042 message. A BOS CFG is added to enable customers to pick a BOS action for the subdivision/district(s) when either of the above CRCs fails. A field is added to dispatch system authority void messages to transmit the dispatch system Authority Void CRC over the authority void from dispatch system to the on-board. A dispatch system Authority Void CRC field is added to the Movement Authority Void (01053) message for the BOS to populate directly with the dispatch system Authority CRC. A field is added to dispatch system bulletin void messages to transmit the dispatch system Bulletin Void CRC over the voided bulletin item from dispatch system to the on-board. A dispatch system Bulletin Void CRC field is added to the Bulletin Cancellation (01043) message. Critical Alert messages are included in the dispatch system Bulletin CRC, implying that the Critical Alert system is capable of the same CRC generation that dispatch system is capable of.

The IC3 or the dispatch system may generate plural CRCs: the dispatch system Authority CRC, dispatch system Authority Void CRC, dispatch system Bulletin CRC, and dispatch system Bulletin Void CRC. Each of the IC3 or dispatch system generated CRCs must be calculated over a set of data that can be determined by both the on-board system and the dispatch system. The IC3 or dispatch system Authority CRC may be determined or calculated over the following fields: Vehicle ID, Authority Type, PVC Authority Reference Number, Void Authority Number for reach authority void, Authority Segment Direction for each authority segment, Authority Segment Track for each authority segment, Authority Segment From Limit for each authority segment, Authority Segment Too Limit for each authority segment, Restriction Type for each authority restriction, Restriction Speed Limit for each authority restriction, Restriction Segment Track for each authority restriction, Restriction Segment From Limit for each authority restriction, Restriction Segment To Limit for each authority restriction, Conditional Track for each conditional item, Conditional Limit for each conditional item, Site Name, and Site Device ID.

The IC3 or dispatch system authority Void CRC may be determined or calculated over the PVC Authority Reference Number field. The IC3 or dispatch system Bulletin CRC may be determined or calculated over the following fields: PVC Bulletin Reference Number, Bulletin Segment Track for each bulletin segment, Bulletin Segment From Limit for each bulletin segment, Bulletin Segment To Limit for each bulletin segment, Speed Restriction Type for each bulletin segment, Speed Restriction Applicability for each speed restriction, Speed, Restricted Speed for each speed restriction, Effective Date/Time, Expiration Date/Time, and Department of Transportation (DOT) ID.

The IC3 or dispatch system Bulletin Void CRC may be determined or calculated over the PVC Bulletin Reference Number field. Each customer dispatch system calculates a dispatch system Authority CRC according to the proposed field definitions and order described herein. A new field to accommodate the dispatch system Authority CRC is added to each railroad's authority message. Each customer dispatch system calculates a dispatch system Authority Void CRC according to the proposed field definitions and order described herein. A new field to accommodate the dispatch system Authority Void CRC is added to each railroad's authority void message. Each customer dispatch system calculates a dispatch system Bulletin CRC according to the proposed field definitions and order described herein. A new field to accommodate the dispatch system Bulletin CRC is added to each railroad's bulletin message(s). Each customer dispatch system calculates a dispatch system Bulletin Void CRC according to the proposed field definitions described herein. A new field to accommodate the dispatch system Bulletin Void CRC is added to each railroad's bulletin void/cancel/release message. The dispatch system performs the same message field transformation that the on-board system performs so that the CRCs match. Some field enumerations may need to change, or transformation will take place to more closely match the on-board messaging.

The BOS populates the Movement Authority Dataset (01051) message with the new dispatch system Authority CRC, adds requirement(s) to respond to a NAK in the Confirmation of Authority Dataset (02052) message with the new event (based on CFG), populates the Movement Authority Void (01053) message with the new dispatch system Authority Void CRC, populates the Bulletin Dataset (01041) message with the new dispatch system Bulletin CRC, add requirement(s) to respond to a NAK in the Confirmation of Bulletin Dataset (02042) message with the new event based on CFG), populates the Bulletin Cancellation (01043) message with the new dispatch system Bulletin Void CRC, add a new event to log and notify per railroad direction, and adds a new CFG to control BOS action on receiving a NAK from a locomotive.

The on-board system is updated to verify each of the dispatch system generated MD CRCs. The on-board system is updated to verify the dispatch system Authority CRC when the on-board system receives a Movement Authority Dataset (01051) message from the BOS, and the dispatch system Authority Void CRC when the on-board system receives a Movement Authority Void (01053) message from the BOS. The on-board system calculates the dispatch system Authority CRC or dispatch system Authority Void CRC based upon the data within the Movement Authority Dataset (01051) or Movement Authority Void (01053) message. The on-board system compares the on-board calculated MD CRC to the dispatch system MD CRC received within the Movement Authority Dataset (01051) or Movement Authority Void (01053) message. If the on-board calculated MD CRC matches the dispatch system MD CRC in addition to existing verification items, the on-board system sends the confirmation message (02052/02053) with a positive acknowledgement to BOS. If the on-board calculated MD CRC does not match the dispatch system MD CRC, the on-board system sets the associated subdivision/district to non-synchronized and sends the confirmation (02052/02053) message with a negative acknowledgement to BOS. The on-board system is updated to verify the dispatch system Bulletin CRC when the on-board system receives a Bulletin Dataset (01041) message from the BOS, and the dispatch system Bulletin Void CRC when it receives a Bulletin Cancellation (01043) message from BOS. The on-board system calculates the dispatch system Bulletin CRC or dispatch system Bulletin Void CRC based upon the data within the Bulletin Dataset (01041) or Bulletin Cancellation (01043) message. The on-board system compares the on-board calculated MD CRC to the dispatch system MD CRC received within the Bulletin Dataset (01041) or Bulletin Cancellation (01043) message. If the On-board calculated MD CRC matches the dispatch system MD CRC in addition to existing verification items, the on-board segment sends the confirmation message (02042/02043) with a positive acknowledgement to BOS. If the on-board calculated MD CRC does not match the dispatch system MD CRC, the on-board segment sets the associated subdivision/district to non-synchronized and the confirmation message (02042/02043) with a negative acknowledgement to BOS.

In one embodiment, an Office-Locomotive ICD may be modified to add a new field in the Movement Authority Dataset (01051) message to a locomotive for the dispatch system Authority CRC, and a new enumeration m the Confirmation of Authority Dataset (02052) message. The Office-Locomotive ICD may be modified to add a new field in the Movement Authority Void (01053) message to a locomotive for the dispatch system Authority Void CRC, and a new enumeration in the Confirmation of Authority Dataset (02052) message. The Office-Locomotive ICD may be modified to add a new field in the Bulletin Dataset (01041) message to a locomotive for the dispatch system Bulletin CRC, and a new enumeration in the Confirmation of Bulletin Dataset (02042) message. The Office-Locomotive ICD may be modified to add a new field in the Bulletin Cancellation (01043) message to a locomotive for the dispatch system Bulletin Void CRC, and a new enumeration in the Confirmation of Bulletin Dataset (02042) message.

The dispatch system CRC based end-to-end MD CRC verification mitigates or potentially addresses one or more of the challenges discussed above. The on-board system verifies the MD CRC for an enforceable instruction, ensuring operational data is not being altered as sent from dispatch system. When operational data corruption is detected, the on-board system sets the associated subdivision/district to non-synchronized and performing associated existing behaviors. The on-board system clearly indicates that the on-board system is not providing PVC protection while the vehicle group is operating in a non-synchronized subdivision.

An Assurance Concept utilized with a dispatch system CRC based method and system may be a Diversity and Self-Checking process implemented as a Self-Checking Code. Incorporation of the dispatch system Authority CRC or dispatch system Bulletin CRC data into the BOS created enforceable instruction messages enables the on-board processors to validate that the operational data is received as sent from the dispatch system.

After the on-board system has validated the dispatch system MD CRC for a received MD, the on-board system transforms the provided milepost data to the block and offset data associated with the track database. The vehicle control system should ensure that the result of the transformation is equivalent to the original milepost data and ensure that the vehicle control system enforces the data physical location specified by dispatch system. Accordingly, and as discussed, three issues that result in incorrect transformation results may include: software errors, hardware errors, and track database errors. Software errors, including requirements, implementation, and compilation may result in transformed enforceable instruction set pointing to incorrect location(s) within the track database.

Triplex design may mitigate the second challenge where random hardware faults result in an error in the enforceable instruction set transformation. The Triplex design, in conjunction with the cross channel comparison, may detect issues related to faulty hardware that could alter the results of the enforceable instruction set transformation. The final challenge is that enforceable instruction set milepost limits are not at the correct physical location. The vehicle control system mitigation may use a provided production version CRC-protected track database to be validated for correctness prior to being used for PVC operation. Once a track database has been validated, version confirmation during initialization, CRC verification and cross channel comparison of databases in use may transform milepost data to block and offset.

With respect to synchronization events, certain scenarios should be considered. For a first scenario, an enforceable instruction is on-board that is not included in the Office Segment Poll (01021) due to polling timing. The G BOS issues a poll at the same time as the G BOS receives a new enforceable instruction from vehicle control systems. The G BOS issues the new enforceable instruction that was not included in the poll. Due to messaging system delay and the order of messages not being guaranteed, the on-board system receives the new enforceable instruction first and adds the enforceable instruction to its calculated Dataset CRC. The on-board system receives the Office Segment Poll (01021) second and detects a mismatched Dataset CRC because the new enforceable instruction was not included in the message. The on-board system sets the associated subdivision/district to non-synchronized. This scenario may occur if vehicle control systems issues an enforceable instruction at about the same time as the G BOS needs to send a poll. The result is indeterminate as to whether the enforceable instruction is included in the poll and the order the messages reached the on-board. It should be noted that current on-board behavior sends the Request Dataset List (02022) message to the G BOS. The Dataset List (01022) message sent by the G BOS shows the on-board system does have the correct an enforceable instruction. The on-board system waits until the next poll timeout for the next opportunity to become synchronized.

In a second scenario, the enforceable instruction on-board are not the same as included in the Office Segment Poll (01021) due to crew action. The G BOS issues a poll. The crew responds to an authority prompt for an authority that requires crew action (acknowledge/accept/reject). The on-board system receives an Office Segment Poll (01021) message that does not include the result of the crew action and detects a mismatched Dataset CRC. The on-board system sets the associated subdivision/district to non-synchronized. This occurs when the crew action happens at about the same time as the G BOS sends a poll. The result is that the on-board becomes non-synchronized for the subdivision/district until the next Office Segment Poll (01021) message is received. The on-board system waits until the next poll timeout for the next opportunity to become synchronized. In both the first and the second scenario, the time which the on-board system is non-synchronized is the duration of the poll. In both scenarios, the on-board system becomes synchronized after the next poll is received providing that all other conditions are met for it to be synchronized. It should be noted that this is most important for subdivisions that are near to the locomotive which can cause the on-board system to become Disengaged. A mismatch of the IC3 Composite CRC is more costly to the system, in terms of operational availability, than a Dataset CRC mismatch. This is because the result of the IC3 Composite CRC mismatch may use a dispatch system—G BOS sync which prevents the on-board system from becoming synchronized with G BOS for the poll duration plus dispatch system—G BOS sync duration (worst case).

In a third scenario, the on-board system determines that the Dataset CRC matches and the IC3 Composite CRC does not match due to poll timing. The G BOS determines that the G BOS needs to issue a poll due to a timeout. The G BOS requests the IC3 Composite CRC from the IC3. The G BOS and the IC3 each receive a new enforceable instruction. The IC3 sends the IC3 Composite CRC to the G BOS. The G BOS issues the poll to the on-board system. The on-board system receives the poll. The on-board system determines the Dataset CRC matches and the IC3 Composite CRC does not. The on-board system sets the associated subdivision/district to non-synchronized and responds with a Poll Response (02021) message indicating an IC3 Composite CRC mismatch. The G BOS resynchronizes with dispatch system. In this scenario, it is indeterminate whether the Dataset CRC and the IC3 Composite CRC represent the same set of an enforceable instruction due to unfortunate timing of events. The on-board system detects that G BOS has not associated the correct set of an enforceable instruction when it determines that the IC3 Composite CRC does not match. The G BOS may resynchronize with vehicle control systems to recover.

Figure 9:
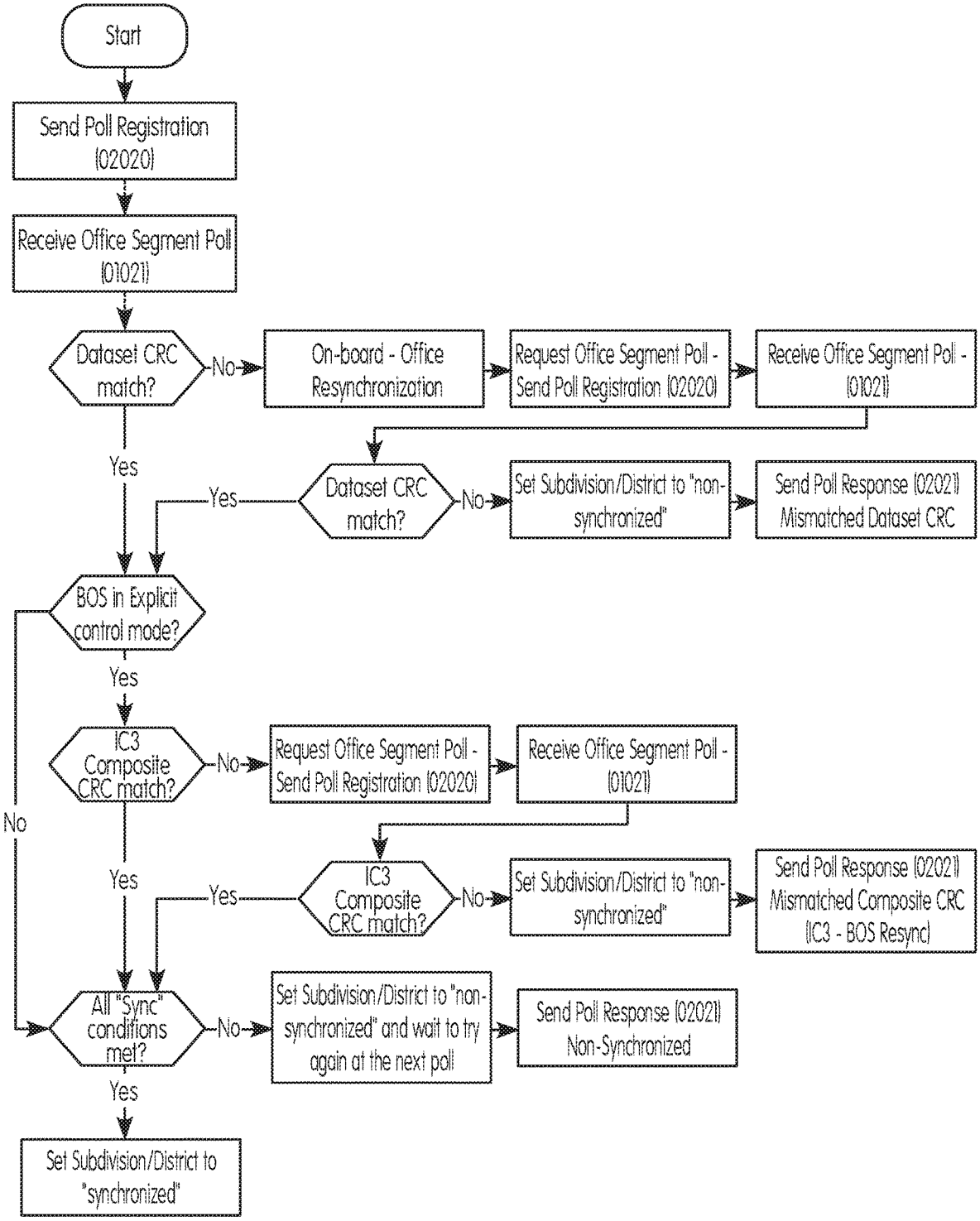
FIG. 9 is a flow chart of an updated polling process from an on-board perspective according to an embodiment.

If undesirable timing results in an inadvertent operational outage, aspects of the system may alter a current polling process to allow the on-board system to provide PVC functions and protection for a configured period of time while the on-board system has no communication with the office. FIG. 9 is a flow chart of an updated polling process from an on-board perspective according to an embodiment. The vehicle control system, e.g., the I-ETMS, may be updated to allow a tolerance for non-synchronized conditions that is within the polling tolerance. Accordingly, the on-board system may request an updated Office Segment Poll (01021) message from G BOS when either the Dataset CRC or IC3 Composite CRC do not match what may be determined or calculated.

Figure 10:
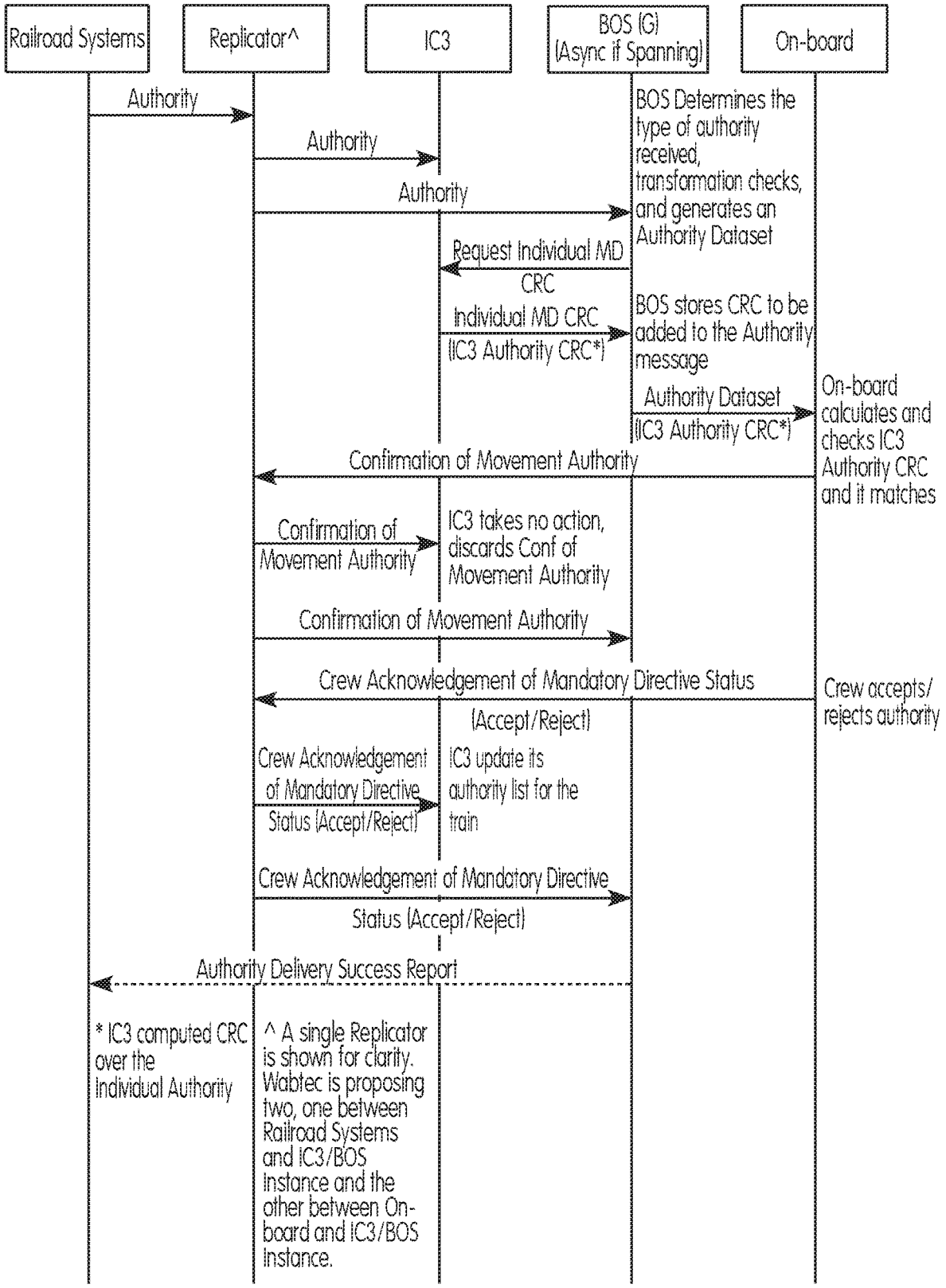
FIG. 10 is a flow diagram showing behavior of various segments when the on-board system detects a mismatch for an IC3 Authority CRC.
Figure 11:
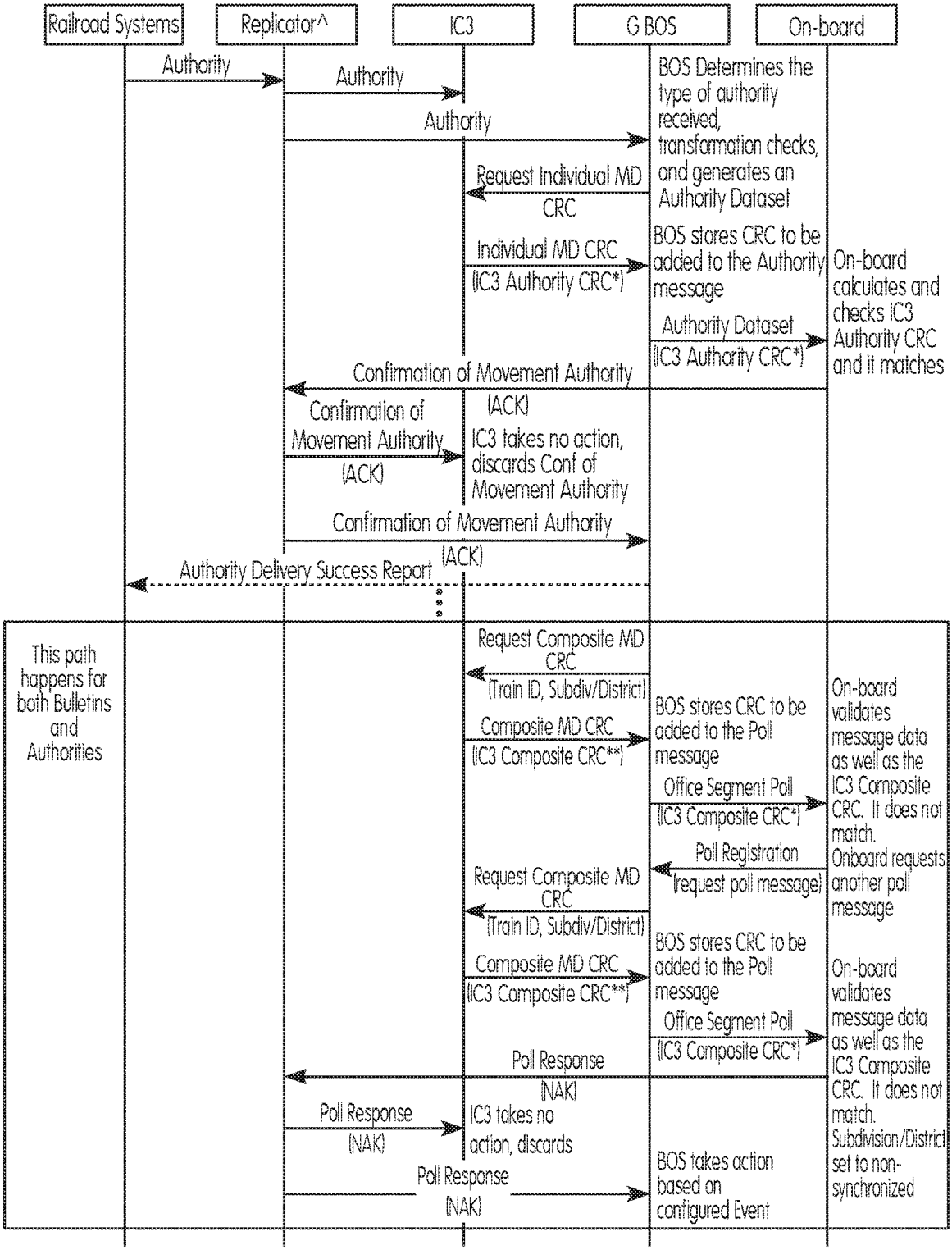
FIG. 11 is a flow diagram showing behavior of various segments when the on-board segment detects a mismatch for an IC3 Composite CRC.

FIG. 10 is a flow diagram showing behavior of various segments according to one embodiment when the on-board system detects a mismatch for an IC3 Authority CRC. FIG. 11 is a flow diagram showing behavior of various segments according to one embodiment when the on-board segment detects a mismatch for an IC3 Composite CRC. The on-board system is updated to request another Office Segment Poll (01021) message after a synchronization attempt with the office. When the on-board receives an unsolicited Office Segment Poll (01021) message that results in a Dataset CRC mismatch, the on-board system attempts to resynchronize datasets with the office. This behavior is left unchanged. After the on-board has determined that the set of enforceable instruction datasets on-board matches the set received in the Dataset List (01022) message, if the Dataset CRC still does not match, the on-board system requests an updated Office Segment Poll (01021) message. After the Office Segment Poll (01021) message is received, the on-board system compares the Dataset CRC again. If the Dataset CRC is a match, the on-board system continues to compare the IC3 Composite CRC. If the Dataset CRC is still a mismatch, the on-board system sets the subdivision/district to non-synchronized and sends the Poll Response (02021) message indicating a mismatched Dataset CRC. The on-board system is updated to request another Office Segment Poll (01021) message after an IC3 Composite CRC mismatch. If the requested Office Segment Poll (01021) message still is a mismatch with the calculated IC3 Composite CRC, the on-board system sets the associated subdivision/district to non-synchronized and sends the Poll Response (02021) message indicating a mismatched IC3 Composite CRC. Timing issues that could cause an enforceable instruction represented in the Dataset CRC to not match the those represented in the IC3 Composite CRC should be resolved by the time the requested poll is sent. The Poll Registration (02020) message is used to request a poll as well as register for polling. The message will be updated to include an enumeration to differentiate a poll registration from a poll request. G BOS will be updated to respond to a Poll Registration (02020) message requesting a poll with an immediate response with the Office Segment Poll (01021) message. Certain G BOS modes and control thereof according to embodiments are described in more detail below.

During a Non-Explicit control mode, the G BOS only sends more restrictive an enforceable instruction to the on-board system for the associated subdivision/district. The IC3 does not have the same logic. This may cause the IC3 Composite CRC to be inconsistent with the Dataset CRC in the Office Segment Poll (01021) message during Non-Explicit control G BOS mode.

Because the G BOS determines whether to send an enforceable instruction to a vehicle group during the Non-Explicit control mode based on the restrictiveness of the enforceable instruction, the enforceable instruction may not be included in the Dataset CRC but is included in the IC3 Composite CRC in the Office Segment Poll (01021) message. Because the on-board system knows the G BOS operating mode of the subdivision/district, the on-board system ignores the IC3 Composite CRC while the G BOS is in the Non-Explicit control mode. Current BOS requirements allow the G BOS to be configured with a timeout for Non-Explicit control mode (CFG 65). When the timeout expires, the G BOS transitions to Synchronize or Stop mode depending on configuration (CFG 6). Because the IC3 Composite CRC validations should not be allowed to be bypassed for an indefinite time period, the G BOS is updated to remove the configurability of the Non-Explicit control mode timeout (CFG 65). The timeout is always in effect when a G BOS is in Non-Explicit control mode. The timeout may be configured (TBC 109) by operators. Implications may include the timeout value representing how much time the G BOS associations between an enforceable instruction and a vehicle group to remain unchecked.

The IC3 Composite CRC may be inconsistent with the Dataset CRC in the Office Segment Poll (01021) message during Synchronize G BOS mode. When the G BOS is in Synchronize mode for a subdivision/district, it inserts a zero in the Dataset CRC field for the associated subdivision/district in the Office Segment Poll (01021) message. Existing behavior has the on-board system ignore the Dataset CRC while the G BOS is in Synchronize mode for a subdivision/district. This behavior is extended to the IC3 Composite CRC. The on-board system ignores the Dataset CRC and the IC3 Composite CRC while the G BOS is in Synchronize mode for the associated subdivision/district.

The BOS and the IC3 may lose communication and/or the IC3 and a replicator may lose communication. A loss of communication between the BOS and the IC3 may be handled in a determined manner. The G BOS waits to receive the IC3 Composite CRC from IC3 before issuing an Office Segment Poll (01021) message to the on-board system. After a determined time without receiving an Office Segment Poll (01021) message for a subdivision/district the on-board system sets the subdivision/district to non-synchronized. A loss of communication between the IC3 and the replicator may be handled in a determined manner. When the G BOS requests the IC3 Composite CRC from IC3, the IC3 still reports the CRC even if it may not have received an enforceable instruction. When the on-board system receives the Office Segment Poll (01021) message the on-board system detects a mismatch with the IC3 Composite CRC and become non-synchronized for the associated subdivision/district. The G BOS waits for the Individual MD CRC before issuing an enforceable instruction. During the communication outage between the IC3 and the replicator, the G BOS may not issue an enforceable instruction. Existing polling behavior may result in determined behavior. The G BOS may add an enforceable instruction to the Dataset CRC but may not issue it to a vehicle or vehicle group without the Individual MD CRC. When the on-board system receives the next Office Segment Poll (01021) message the on-board system detects a mismatch with the Dataset CRC and becomes non-synchronized.

Under certain circumstances, the BOS may detect invalid fields but continue to process the message and use the data within the message body. An invalid message in this may refer to when the data within the message body is not used. The IC3 may validate the message integrity and the fields pertinent to generating the Individual MD CRCs and the IC3 Composite CRC. There are at least three scenarios associated with invalid or lost messages from vehicle control systems or on-board. These include the G BOS and the IC3 not receiving a valid message, only the G BOS not receiving a valid message, and only the IC3 not receiving a valid message.

When both the G BOS and the IC3 do not receive a valid message neither segment may use the data within the message. Both segments continue to operate normally, and the Dataset CRC is consistent with the IC3 Composite CRC. When the G BOS does not receive a valid message that the IC3 receives, the IC3 may use the data from the message but the G BOS does not. If the message is not pertinent to an enforceable instruction and their association with vehicle groups there is no effect to the system. The IC3 does not use the message data. If the message is pertinent to an enforceable instruction and their association with vehicle groups, the IC3 Composite CRC may be inconsistent with the Dataset CRC for a subdivision/district for one or more vehicle groups. If the G BOS is not configured to transition to Synchronize or Stop mode due to the lost or invalid message, the on-board system may detect a mismatch with the IC3 Composite CRC and transition to non-synchronized for the subdivision/district. The on-board system sends the Poll Response (02021) message indicating the mismatch and causing G BOS to transition to Synchronize or Stop mode for the subdivision/district.

When the IC3 does not receive a valid message that the G BOS receives, the G BOS may use the data from the message but the IC3 does not. Because the G BOS has more thorough message validation the only likely reason for this is an error introduced in the messaging system between the replicator and the IC3. If the message is not pertinent to enforceable instruction and their association with vehicle groups, there is no effect to the system. If the message is pertinent to an enforceable instruction and their association with vehicle groups, the IC3 Composite CRC may be inconsistent with the Dataset CRC for a subdivision/district for one or more vehicle groups. The on-board system detects the IC3 Composite CRC mismatch, asks for another poll message, transitions to non-synchronized for the subdivision/district if the second poll message CRC mismatches, and sends the Poll Response (02021) message indicating the mismatch. The G BOS transitions to Synchronize or Stop mode for the subdivision/district.

The G BOS may request both the IC3 Individual MD CRC and the IC3 Composite CRC from IC3. It is possible that the IC3 is unresponsive or the interface between the two is not functioning properly. The G BOS initiates all exchanges with the IC3. When a valid response is not received, the G BOS retries requesting the desired CRC. The G BOS sends the request a configurable number of times after not receiving a valid response for a configurable time. When the G BOS has exhausted retries, the G BOS transitions to Stop mode for the associated subdivisions/districts. Without IC3 calculated CRCs, on-board system never becomes synchronized for an associated subdivision/district.

Another problem that may arise is that an enforceable instruction may span subdivisions/districts. Each G BOS receives an enforceable instruction associated with the subdivisions/districts that it is configured to control. The IC3 may receive an enforceable instruction associated with the same set of subdivisions/districts. The IC3 does not contain the G BOS logic for determination of async G BOS, nor does the IC3 have a list of subdivisions/districts that G BOS controls, so the IC3 calculates and sends individual CRCs for each vehicle group and subdivision/district to the G BOS for every enforceable instruction that it receives. Because the IC3 receives the same set of an enforceable instruction as G BOS, both the G BOS and the IC3 have the same set of enforceable instruction data. Spanning an enforceable instruction may complicate the calculation of the Individual MD CRCs and IC3 Composite CRC. Accordingly, rules that enable consistent calculation under various spanning scenarios are provided.

In another embodiment, the IC3 and/or the back-office server, e.g., the G BOS, are configured or programmed to compare certain results and detect potential, existing, or imminent problems or issues prior to detection by the on-board system. For example, the enforceable instruction data or results for an enforceable instruction, e.g., the mandatory directive data or results for a mandatory directive, can be compared, where: (1) the G BOS and the IC3 compare a result when each enforceable instruction is received; (2) the G BOS and the IC3 compare the known set of an enforceable instruction on a periodic basis; and/or (3) the G BOS and the IC3 compare a result before the Composite CRC is sent to the on-board system of the locomotive.

The systems and methods provided herein may be provided on a transactional basis whereby messages may be communicated between the BOS or G BOS and vehicles (or vehicle groups) that purchase the ability to communicate messages with the BOS or G BOS. For example, each message may be the subject of a microtransaction between the BOS or G BOS and the vehicle (or vehicle group), or the ability to communicate messages with the BOS or G BOS may be purchased for a designated time period, while the vehicle (or vehicle group) is traveling in the territory of the BOS or G BOS, etc. This can allow for vehicles not wanting the ability to communicate with the BOS or G BOS to avoid this communication, while allowing other vehicles to purchase the protections provided by communication with the BOS or G BOS. Incentives may be provided or may be available to vehicles or vehicle groups purchasing the communication ability, such as reduced insurance costs (e.g., reduced premiums or deductibles) or the like.

The communications and checks described herein may not be limited to vehicles or vehicles groups. Additionally or alternatively, the processes described herein may be used to communicate messages, authenticate messages, and/or verify messages between the systems and non-vehicular systems, such as wayside devices (e.g., gates, traffic signals or rail signals, sensors or detectors (such as hot box detectors), switches (such as track switches), or the like). The messages can be sent to change or control operation of the devices, such as to raise or lower a gate, change the color of a light displayed at a signal, activate or deactivate the light generated by a signal, change a position of a switch so that a vehicle passing through or over the switch moves to another route, etc.

The checks described herein may be used not only to verify or test the completeness of a message, but also to ensure that messages are not being originated by or sent from a bad actor, such as a device that is spoofing a vehicle or BOS (or G BOS). Such bad actors may send incorrect information in messages, which can be dangerous to the operation of the vehicles. For example, messages sent from bad actors may fail the authentication or verification processes described herein, while messages sent from authentic vehicles or an authentic BOS (or G BOS) may pass the authentication or verification processes described herein.

Figure 12:
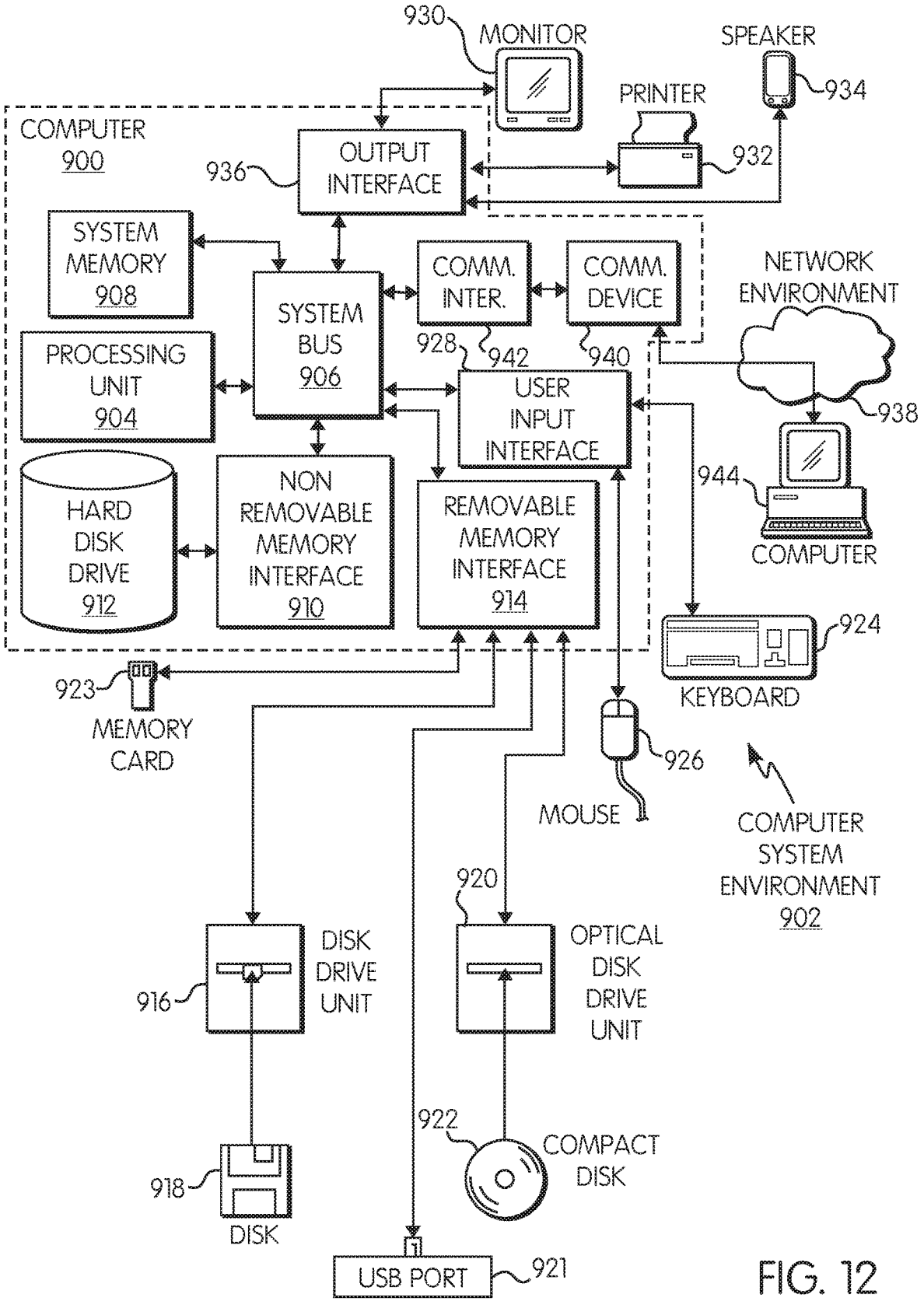
FIG. 12 illustrates a block diagram of a computer system according to aspects of the invention.

The system and methods provided herein may be implemented on one or more controllers. Suitable controllers may include computing devices, servers, processing units, and systems that may include the processing mechanisms and computer-readable media for storing and executing computer-readable instructions, such as programming instructions, code, and the like. As shown in FIG. 12, computers or controllers 900, 944, in a computing system environment 902 are provided. This computing system environment may include a computer having certain components for appropriate operation, execution of code, and creation and communication of data. For example, the controller may include a processing unit (such as a central processing unit or CPU) that serves to execute computer-based instructions received in the appropriate data form and format. Further, this processing unit may be in the form of multiple processors executing code in series or in parallel.

The controller may use a system bus 906. A suitable system bus may include a memory bus or memory controller, a peripheral bus, or a local bus using a bus architecture. The system bus may facilitate data and information communication between the various components (whether internal or external to the controller) through a variety of interfaces.

The controller may include a variety of discrete computer-readable media components. For example, this computer-readable media may be accessed by the controller. The computer-readable media may include computer storage media. Further, this computer-readable media may include communications media, such as computer-readable instructions, data structures, program modules, or other data in other transport mechanisms and include information delivery media, wired media (such as a wired network and a direct-wired connection), and wireless media. Computer-readable media may include all machine-readable media with the possible exception of transitory, propagating signals.

The controller may include a system memory 908 with computer storage media in the form of volatile and non-volatile memory, such as ROM and RAM. A basic input/output system (BIOS) with appropriate computer-based routines assists in transferring information between components within the controller and is normally stored in ROM. The RAM portion of the system memory may contain data and program modules that are immediately accessible to or presently being operated on by processing unit 904, e.g., an operating system, application programming interfaces, application programs, program modules, program data and other instruction-based computer-readable codes. With continued reference to FIG. 12, the controller may include other removable or non-removable, volatile or non-volatile computer storage media products. For example, the controller may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or non-volatile magnetic media are in communication with the processing unit and other components of the computer via the system bus. The drives and their associated computer storage media discussed above and illustrated in FIG. 12 provide storage of operating systems, computer-readable instructions, application programs, data structures, program modules, program data and other instruction-based computer-readable code for the controller (whether duplicative or not of this information and data in the system memory).

A user may enter commands, information, and data into the controller through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including an arrangement that facilitates the input of data, and information to the controller from an outside source. Data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the controller through an output interface 936 coupled to the system bus.

The controller may operate in a network environment 938 through the use of a communications device 940, which is integral to the computer or remote therefrom. This communications device is operable by and in communication to the other components of the controller through a communications interface 942. Using such an arrangement, the controller may connect with or otherwise communicate with one or more remote computers, such as a remote controller. A suitable controller may be a personal computer, a server, a router, a network personal computer, a peer device, or a network node. Using suitable communication devices, e.g., a modem, a network interface or adapter, etc., the controller may operate within and communication through a local area network (LAN) and a wide area network (WAN), but may include other networks such as a virtual private network (VPN), an office network, an enterprise network, an intranet, the Internet, etc.

Vehicles, vehicle groups, and wayside equipment may be instrumented with sensors that may communicate back to the vehicle control system various items of operational data during use. Examples may include informing the PVC that a vehicle is moving (or not), is located in a certain geographic region or on a particular route segment, is moving at a particular speed, whether that movement speed is above or below a speed limit set in an applicable bulleting, what version equipment the vehicle possesses, what version software the vehicle is running, what is the health status of the vehicle, what is the health status of the vehicle's communication equipment, and the like. The controller may determine whether there are any mismatches or discrepancies between data supplied by the vehicle to the PVC and the informational set upon which the PVC is relying (or did rely on) in releasing the movement authority, the bulletin, any voids, and the like. In the event of a determined mismatch, the PVC may respond by modifying movement authorities or sending bulletins to the vehicle, the vehicle group in which the vehicle is located, or other vehicles or vehicle groups.

In one embodiment, the controllers or systems described herein may have a local data collection system deployed and may use machine learning to enable derivation-based learning outcomes. The controllers may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used making determinations, calculations, comparisons and behavior analytics, and the like.

In one embodiment, the controllers may include a policy engine that may apply one or more policies. These policies may be based at least in part on characteristics of a given item of equipment or environment. With respect to control policies, a neural network can receive input of a number of environmental and task-related parameters. These parameters may include, for example, operational input regarding operating equipment, data from various sensors, location and/or position data, and the like. The neural network can be trained to generate an output based on these inputs, with the output representing an action or sequence of actions that the equipment or system should take to accomplish the goal of the operation. During operation of one embodiment, a determination can occur by processing the inputs through the parameters of the neural network to generate a value at the output node designating that action as the desired action. This action may translate into a signal that may use the vehicle to operate. This may be accomplished via backpropagation, feed forward may process, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

As used herein, an element or step recited in the singular and preceded with the word "a" or "an" should be do not exclude plural of said elements or steps, unless such exclusion is explicitly stated. Furthermore, references to "one embodiment" or "one example" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description may use examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method, comprising:

transmitting an enforceable instruction from a dispatch system to at least one vehicle of a vehicle group, and the enforceable instruction comprising:

a movement authority for a determined route segment, a checksum component configured to determine validity of the enforceable instruction, and an authentication component configured to determine an authenticity of the enforceable instruction; and operating the at least one vehicle according to the movement authority responsive to the authentication component determining that the enforceable instruction is authentic.

2. The method of claim 1, further comprising transmitting a bulletin message to the at least one vehicle, and further operating the at least one vehicle with a limit or restriction provided by the bulletin message and according to the movement authority in a route segment.

3. The method of claim 1, wherein the at least one vehicle may be disposed within a first vehicle system or a second vehicle system, and the method further comprising determining which vehicle system the at least one vehicle is disposed in, and the first vehicle system and the second vehicle system using different formats for the enforceable instruction relative to each other, and responsive to determining that the enforceable instruction is intended for use by the at least one vehicle within the first vehicle system, converting the enforceable instruction from a dispatch center into a first format that is used by the first vehicle system.

4. The method of claim 3, wherein the second format is different than a native format of the dispatch system and is different than the first format of the first vehicle system.

5. The method of claim 1, further comprising:

determining that the at least one vehicle of the vehicle group is a correct vehicle for the enforceable instruction; and transmitting a response to a dispatch center from the at least one vehicle that is responsive to determining that the enforceable instruction is intended for use by the vehicle group.

6. The method of claim 5, wherein the response to the dispatch center comprises geographical data relating to a location of the at least one vehicle.

7. The method of claim 1, wherein an enforceable instruction checksum is readable by an on-board system of the at least one vehicle in a different, third format, and the method further comprising converting the enforceable instruction checksum that is received into the third format.

8. The method of claim 1, wherein the vehicle group comprises both the at least one vehicle and a second vehicle, and the second vehicle is blocked or prohibited from receiving the enforceable instruction from a dispatch center that relates to the at least one vehicle.

9. The method of claim 8, wherein a checksum calculator is disposed remote from the dispatch center, the at least one vehicle, and the second vehicle, and the method further comprises receiving a replicated message of the enforceable instruction from the dispatch.

10. The method of claim 8, further comprising determining whether the enforceable instruction is intended for the at least the one vehicle or the second vehicle based at least in part on a location of the at least one vehicle and a location of the second vehicle.

11. The method of claim 1, wherein the authentication component that is configured to determine the authenticity of the enforceable instruction validates that the enforceable instruction is a hash function.

12. The method of claim 1, wherein transmitting an enforceable instruction from a dispatch system to at least one vehicle of a vehicle system comprises applying the movement authority to every vehicle in the vehicle group.

13. The method of claim 12, further comprising applying a bulletin to every vehicle in the vehicle group, with the bulletin being a restriction or limit on the movement of every vehicle in the vehicle group.

14. The method of claim 1, further comprising determining if the checksum component is correct, and voiding or invalidating the enforceable instruction in response to a failure of the checksum component.

15. The method of claim 1, further comprising determining if the authentication component is correct, and voiding or invalidating the enforceable instruction in response to a failure of the authentication component.

16. A vehicle control system, comprising:

a controller configured to transmit an enforceable instruction from a dispatch system to at least one vehicle of a vehicle group, the enforceable instruction comprising a movement authority for a determined route segment, a checksum component configured to determine validity of the enforceable instruction, and an authentication component configured to determine the authenticity of the enforceable instruction, the controller configured to operate the at least one vehicle according to the movement authority.

17. The system of claim 16, wherein the controller is further configured to transmit a bulletin message to the at least one vehicle, and to operate the at least one vehicle with a limit or restriction provided by the bulletin message and according to the movement authority in the route segment.

18. The system of claim 16, wherein the vehicle control system is a back office system (BOS); the vehicle group comprises a convoy, fleet, swarm, or consist; and the at least one vehicle is an on-road truck or automobile.

19. The system of claim 16, wherein the controller is configured to receive operational information that relates to the movement authority back from the at least one vehicle.

20. A positive train control system, comprising:

a controller configured to transmit an enforceable instruction from a dispatch system to at least one locomotive of a train, the enforceable instruction comprising:

a movement authority for a determined route segment, a checksum component configured to determine validity of the enforceable instruction, and an authentication component configured to determine the authenticity of the enforceable instruction, the controller configured to determine that the locomotive is a correct locomotive for the enforceable instruction, operate the locomotive according to the movement authority, transmit a bulletin message to locomotive, and to operate the locomotive with a limit or restriction provided by the bulletin message and according to the movement authority in the route segment.

* * * * *